US007160389B2

(12) United States Patent
Gibson et al.

(10) Patent No.: US 7,160,389 B2
(45) Date of Patent: Jan. 9, 2007

(54) SYSTEM AND METHOD FOR CLEANING AND PRIMING AN EXTRUSION HEAD

(75) Inventors: Gregory M. Gibson, Dallas, TX (US); John E. Hawes, Grapevine, TX (US); Samer M. Kabbani, Dallas, TX (US); Ocie T. Snodgrass, Dallas, TX (US)

(73) Assignee: FAStar, Ltd., Dallas, TX (US)

( * ) Notice: Subject to any disclaimer, the term of this patent is extended or adjusted under 35 U.S.C. 154(b) by 0 days.

(21) Appl. No.: 10/308,840

(22) Filed: Dec. 3, 2002

(65) Prior Publication Data

US 2004/0007174 A1 Jan. 15, 2004

Related U.S. Application Data

(63) Continuation-in-part of application No. 09/227,381, filed on Jan. 8, 1999, now Pat. No. 6,488,041.

(60) Provisional application No. 60/070,986, filed on Jan. 9, 1998.

(51) Int. Cl.
*B05C 1/00* (2006.01)

(52) U.S. Cl. ..... 118/302; 239/114; 239/123; 222/148; 425/229

(58) Field of Classification Search ..... 118/302, 118/203, 261; 134/166 R, 169 R; 347/22, 347/28, 33; 239/112, 113, 114, 115, 123; 425/229; 222/148; 427/356, 428.14, 428.2
See application file for complete search history.

(56) References Cited

U.S. PATENT DOCUMENTS 3,146,950 A * 9/1964 Lancaster ..... 239/128
3,405,682 A * 10/1968 King et al. ..... 399/149
4,052,305 A * 10/1977 Arvanitakis ..... 210/791
4,567,494 A * 1/1986 Taylor ..... 347/30
4,860,883 A * 8/1989 Knaul et al. ..... 198/495
4,895,603 A * 1/1990 Semp et al. ..... 134/21
5,002,008 A * 3/1991 Ushijima et al. ..... 118/313
5,136,972 A * 8/1992 Naka et al. ..... 118/410
5,147,028 A * 9/1992 Raggi ..... 198/495
5,213,696 A * 5/1993 Patrone et al. ..... 210/791
5,367,326 A * 11/1994 Pond et al. ..... 347/22

(Continued)

FOREIGN PATENT DOCUMENTS

JP 94703 A * 4/2000

*Primary Examiner*—Laura Edwards
(74) *Attorney, Agent, or Firm*—Winstead Sechrest & Minick, P.C.; Henry L. Ehrlich

(57) ABSTRACT

The present invention relates to a system and method suitable for automatic cleaning of a coating or extrusion head of a coating apparatus. The invention includes a scrubbing station wherein a combination of physical contact and strong solvent solution combine to remove coating fluid from the exterior of an extrusion head. A second cleaning station, preferably a rinsing station then further cleans the head of coating fluid and removes solvent used at a first cleaning station. The solvent used at the rinsing station is preferably self-drying thereby obviating the need for any further cleaning action. The invention also provides for the ability to prime the coating bead at the extrusion head so as to have a fully formed bead ready before the head begins coating a substrate, thereby providing an even coating across said substrate. The priming operation preferably comprises holding the head steady over a rotating priming roller while extruding fluid preferably at a constant volumetric flow rate. The extrusion head is removed from the priming station when the coating bead is properly formed, and the extruded coating material is dissolved in a solvent bath at the priming station. The priming operation may also be performed at either of the cleaning stations.

20 Claims, 15 Drawing Sheets

U.S. PATENT DOCUMENTS 5,432,539 A * 7/1995 Anderson ..... 347/33
5,548,310 A * 8/1996 Binnert et al. ..... 347/33
5,574,485 A * 11/1996 Anderson et al. ..... 347/27
5,766,356 A * 6/1998 Kurimoto ..... 118/410
5,793,390 A * 8/1998 Claflin et al. ..... 347/33
5,849,084 A * 12/1998 Hayes et al. ..... 118/320
5,853,812 A * 12/1998 Kawasaki et al. ..... 427/421
6,010,570 A * 1/2000 Motoda et al. ..... 118/323
6,090,216 A * 7/2000 Yamaguchi et al. ..... 134/10
6,145,953 A * 11/2000 Medin ..... 347/28

* cited by examiner

SYSTEM AND METHOD FOR CLEANING AND PRIMING AN EXTRUSION HEAD

RELATED APPLICATIONS

This application is a continuation-in-part of, and claims priority to, U.S. Ser. No. 09/227,381, now U.S. Pat. No. 6.488,401, entitled SYSTEM AND METHOD FOR CLEANING AND PRIMING AN EXTRUSION HEAD filed on Jan. 8, 1999, which is a non-provisional of U.S. Provisional Application Ser. No. 60/070,986 filed Jan. 9, 1998, entitled METHOD AND APPARATUS FOR EXTRUSION COATING the disclosure of which is incorporated herein by reference.

The present application is also related to commonly assigned U.S. Pat. No. 6,475,282 issued Nov. 11, 2002 entitled INTELLIGENT CONTROL SYSTEM FOR EXTRUSION HEAD DISPENSEMENT; U.S. Pat. No. 6,092,937 issued Jul. 25, 2000 entitled LINEAR DEVELOPER; U.S. Pat. No. 6,387,184 issued May 14, 2002 entitled SYSTEM AND METHOD FOR INTERCHANGEABLY INTERFACING WET COMPONENTS WITH A COATING APPARATUS; U.S. Pat. No. 6,319,323 issued Nov. 20, 2002 entitled SYSTEM AND METHOD FOR ADJUSTING A WORKING DISTANCE TO CORRESPOND WITH THE WORK SPACE. U.S. Pat. No. 6.548,115 entitled SYSTEM AND METHOD FOR PROVIDING COATING OF SUBSTRATES; and U.S. Pat. No. 6,540,833 entitled MOVING HEAD COATING APPARATUS AND METHOD. All of which are incorporated herein by reference.

TECHNICAL FIELD

The present invention relates to in general to a method and system for cleaning and priming an extrusion head, and in particular to performing such cleaning and priming in a thorough and space efficient manner adaptable for use an automatic coating apparatus.

BACKGROUND

Extrusion coating is a known method of directly depositing process coatings onto substrates, wafers, flat panel displays, and similar objects (collectively "substrates") in the microelectronics and display technology industries. According to a typical prior art system, substrates are transported linearly beneath an extrusion coating head, and process fluids are precisely dispensed from a linear orifice in the extrusion head using a microprocessor-based electrohydraulic pumping system. One such system is described in U.S. Pat. No. 4,696,885 entitled "METHOD OF FORMING A LARGE SURFACE AREA INTEGRATED CIRCUIT". Depending on the particular application, such process fluids include photoresist, polyimides, color filter materials and the like. Such extrusion coating techniques are well-suited for research and development activities as well as high volume production requirements.

Although known extrusion systems of this type provide significant advantages as compared to other liquid deposition techniques (such as spin coating), they often suffer from a similar problem, specifically, the inability of the coating head to establish a uniform coating at the leading edge of the substrate during certain applications. In these systems, each substrate is a discrete part unlike a web coating process, and the coating deposition is therefore started and stopped with each new substrate. With such part by part processing, a coating "bead" must be re-formed between the extrusion head and each new substrate to thereby "wet" the surfaces. When this bead initially contacts the substrate, however, it may cause a "perturbation" for some measurable distance (e.g., 5–20 mm) from the leading edge of the coating. Sometimes a leading edge anomaly of this type dictates that the substrate be rejected completely, thus increasing material and process costs and decreasing process efficiency.

There have been attempts in the art to address the problem of establishing a uniform coating condition in a linear or so-called slot type extrusion coater, and systems of this type are illustrated in U.S. Pat. Nos. 4,938,994 entitled "METHOD AND APPARATUS FOR PATCH COATING PRINTED CIRCUIT BOARDS" and U.S. Pat. No. 5,183,508 titled "APPARATUS FOR PATCH COATING PRINTED CIRCUIT BOARDS". In these patents, a controlled volumetric flow rate of the liquid is delivered to a liquid containing chamber within the extrusion head and then through the applicator slot to create what is said to be a uniform volumetric flow rate of liquid exiting from each point along the slot. A displacement piston associated with the extrusion head generates a fluid pulse to control the formation of a connecting bead of the liquid coating prior to, at the same time as, or after the sending of the controlled volumetric flow rate of the liquid. This technique purports to apply a layer of the liquid with a precisely-controlled volume per unit area of the liquid to the substrate. Prior art machines also include a slot sealing unit that cleans the extrusion head slot between applications. The prior art systems however, do not effect a condition for the extrusion head at the beginning of a coating operation which mimics the head's condition in the middle of a coating operation. Therefore the problem of a gradual drift towards a steady state coating rate remains, resulting in leading edge perturbations. Therefore, prior art techniques do not adequately address the problem of leading edge perturbations that may affect the uniformity of the coating.

In order to avoid dripping or smearing coating material which has gathered around the extrusion head after a coating operation, it is often necessary to clean the extrusion head before a new coating operation begins. In the prior art, cleaning of extrusion mechanisms is usually accomplished manually, potentially leading to inconsistent results and disruption and delay of the coating operations. The presence of residual coating material on the extrusion during a coating operation can result in unwanted deposition of coating material, or contaminants which have collected on the residual material, on the substrate and/or on part of the coating apparatus. Therefore, it is a problem in the art that manual cleaning operations are inconsistent and unreliable.

Therefore there is a need in the art for a mechanism to overcome the problem of leading edge anomalies arising during the slot type coating of substrates in a batch process.

There is a further need in the art for a mechanism which will effectively and consistently clean an extrusion head so as to prevent dripping coating material onto a substrate or other surface.

SUMMARY OF THE INVENTION

These and other objects, features and technical advantages are achieved by a system and method which provides for a cleaning and priming assembly enabling automatic cleaning and priming of an extrusion or dispensing head at selected times.

A preferred embodiment of the present invention comprises a station comprising a cleaning station and a priming station at which cleaning and priming operations can preferably be performed automatically upon bringing an extrusion head to said station.

In a preferred embodiment of the invention, one cleaning operation would comprise a forceful cleaning process in which particularly viscous or heavy fluid buildups, including dried coating material, could be cleaned from the exterior of an extrusion head, which buildups are not amenable to being cleaned by fluid alone. Preferably, this forceful cleaning operation is performed at a scrubbing station. The forceful cleaning operation preferably involves direct mechanical contact between elements of the cleaning station and the extrusion head. In a preferred embodiment, this mechanical contact is in the form of scrubbers which contact a sufficient distance along the exterior of the extrusion head to remove all material buildup.

Preferably, the scrubbers comprise a large number of bristles which contact the extrusion head thereby transferring coating material from the head to the bristles. Alternatively, the scrubbers could comprise a surface comprising cloth, sponge or other suitable material which contacts the head and removes material through a combination of absorption and wiping contact.

The forceful cleaning mechanism, whether bristles or other device, preferably contacts the head in conjunction with a fluid spray or rinse to assist in transferring coating material away from the exterior of the head. Preferably, fluid would be kept in a reservoir and be continuously pumped toward the point of contact between the bristles or other contact device and the extrusion head. A constant pool of fluid could be used which would preferably be replaced at selected intervals. In a preferred embodiment, the fluid to be used in conjunction with the scrubbers is a strong solvent consistent with the expectation that this cleaning operation is directed toward cleanup of viscous material. The use of a solvent aids in the cleaning process by helping break down the coating material while it is still on the head surface and in keeping the scrubbers clean by dissolving coating material which has been transferred onto the scrubbers. Alternatively, a chemically inert or other fluid could be employed to provide lubrication for the contact of the cleaning mechanism with the head as well as to carry away coating material which has been removed.

Preferably, relative motion would be implemented between the bristles or other contact device and the head in order to achieve the most thorough possible scrubbing coverage of the surface to be cleaned of excess material. In a preferred embodiment, at least one cylindrical scrubber would rotate about an axis parallel to the head, against the surface of the head, thereby providing the desired relative motion within a compact space. The axis of this cylindrical scrubber is preferably fixed thereby aiding in providing a minimal footprint, but could be mobile, linearly or angularly, under spring loading or under some form of controlled motion so as to reach a greater surface area on the exterior of the head or to allow adjustment in the cleaning pressure exerted thereby.

Alternatively, the desired relative motion between the scrubbers and the head could be achieved through linear motion of either the head or the scrubbers or both. Further, the scrubbers could experience a combination of linear motion, and rotational motion about an axis perpendicular to the head thereby providing gyration, and enabling more through coverage of the area to be cleaned. Preferably the scrubbers comprise mechanical compliance permitting some amount of linear motion of the scrubbers in the direction of the head without damaging the head.

In a preferred embodiment, material is removed from rotating scrubbers which remove material from the extrusion head by disposing blades or other sturdy surfaces in contact with the scrubber surfaces which act to remove coating material therefrom. Preferably the blades or other surfaces are disposed on the lower side of scrubbers so as not to interfere with the extrusion head, but may be located anywhere within the reach of the scrubbers. The blades are preferably metallic but may be composed of any resilient and sturdy material.

In a preferred embodiment, a rinsing station is deployed as a part of the cleaning station which may be used as the sole cleaning station for the extrusion head, accordingly the above mentioned scrubbing station may be omitted in such an embodiment if desired, or may be used as a sub-station at which more refined cleaning of the head takes place after the head has been cleaned at a scrubbing station. Fluid for the rinsing station is preferably stored in a reservoir which is preferably distinct from the reservoir for the scrubbing station. Alternatively, fluid for both the rinsing and scrubbing stations could share the same reservoir.

Fluid at the rinsing station is preferably intended to remove either non-viscous coating material from the head left over from the coating operation with no scrubbing operation having been performed. Alternatively, fluid at the rinsing station can remove any solvents used at the scrubbing station in addition to any residual coating material left on the head after a scrubbing operation has been performed.

Fluid employed at the rinsing station is preferably self drying thus obviating the need for any further treatment of the extrusion head prior to either beginning coating or initiating priming of the extrusion head. Alternatively, solvent which is not self-drying could be used and means for drying could be employed to ensure that the rinsing fluid is completely removed from the extrusion head. Such means for drying the rinsing solvent off the extrusion head include, but are not limited to generating rapid air flow past the head, and generating heat in the vicinity of the head. However, it should be appreciated that the use of such air flow should be carefully controlled so as not to introduce gas bubbles into the extrusion manifold which may cause coating irregularities.

In a preferred embodiment, fluid for the rinsing station is stored in a reservoir below a station with a "V" shaped groove or similarly shaped cross section into which an extrusion head is brought into proximity. Rinsing fluid or solvent is then pumped from the reservoir through a fluid distribution structure so as to ensure complete and uniform rinsing fluid coverage of the extrusion head surface to be cleaned. Preferably, the fluid is pumped from the reservoir up through vertically oriented holes in the rinsing station material, then fed into a narrow slot generating a uniform curtain of fluid, thereby providing total coverage of the surface to be cleaned. Other possible geometries include, but are not limited to using a single vertical slot along the length of the rinsing station in communication with a second slot which directs the fluid toward the cleaning surface, a single slot beginning at the fluid reservoir initially directed vertically up from the reservoir, but appropriately bent at an appropriate stage so as to direct fluid toward the surface to be cleaned. In an alternative embodiment, the fluid reservoir could be located at the same vertical level as the surface to be cleaned thereby permitting a single straight slot to lead pressurized fluid directly from the reservoir to the surface to be cleaned. It is noted that a variety of possible fluid flow geometries are available which do not depart from the inventive mechanism embodied herein.

In another preferred embodiment, the means for directing rinsing fluid toward the surface to be cleaned comprises deployment of a porous or sintered material which when subject to appropriate pressure will supply a curtain of fluid flow toward the extrusion head surface, thereby providing universal rinsing fluid coverage of the surface to be cleaned.

In another preferred embodiment, a plurality of fluid sprayers, which may optionally be movable, in communication with the fluid reservoir and directed toward the extrusion head surface are deployed such that complete fluid coverage of the surface to be cleaned is achieved. Deployment of the sprayers may be such as to result in either overlapping or non-overlapping spray patterns onto the surface to be cleaned as long as the fluid contacts the entirety of the surface to be cleaned.

In an alternative embodiment, the rinsing station into which the extrusion head is brought into proximity, may have a number of possible shapes including but not limited to a half-circle, square, rectangular, oval and the like.

In an alternative preferred embodiment, the scrubbing and rinsing operations could be deployed at a single station employing either single or separate fluid reservoirs. The scrubbers and rinsing spray mechanisms would be disposed so as not to interfere with each other although each is disposed in a stationary manner. Alternatively, the scrubbers and/or rinsing fluid spray mechanisms could be movable so as to both be able to access the extrusion head without interfering with the other during operation.

In a preferred embodiment of the invention, a priming station is deployed, preferably in proximity to the cleaning station, for initiating a consistent coating bead, or steady state flow condition extrusion head. The extrusion head is preferably but not necessarily cleaned at one or more cleaning stations before being brought to the priming station. An extrusion head is best suited to begin a coating operation with a full and consistent coating bead and without any extraneous coating material present on the exterior of the head. Alternatively, the extrusion or coating head may be brought directly to the priming station without first going to the cleaning stations, particularly if the head is starting its first coating operation within a particular production run. The extrusion head may otherwise proceed directly to the priming station without first going to the cleaning stations if the head is sufficiently clean as to not require cleaning operations at any cleaning station. The number of coating operations between cleaning operations may vary depending on various factors including the coating material used, the head gap (distance between the extrusion head and a substrate being coated) employed, and the size of the substrate.

In a preferred embodiment, the priming station comprises a rotating cylindrical roller immersed in a bath of solvent, in contact with a brush cleaning the roller of coating material transferred from the coating head. The extrusion head is brought into close proximity to the roller, which is preferably metal or other material sufficient to simulate the surface of the substrate to be coated, and begins to extrude coating fluid onto the roller. The initial release of fluid from the head may be inconsistent for a certain period of time. Without a priming process, such inconsistencies would lead to leading edge anomalies on a surface being coated. The extrusion head remains over the roller extruding fluid in the same manner as it would when coating until either a sufficient amount of time elapses or a sufficient amount of coating fluid has been extruded over the priming roller to ensure that the coating bead is now ready for the actual coating operation. Another option for determining completion of the priming process involves sensing the existence of a full coating bead using sensing mechanisms including but not limited to a vision system disposed to view the coating bead, or contact or pressure sensors within the extrusion head. Another mechanism for determining completion of the priming process involves sensing the coating on the roller or other priming surface employing a vision system or contact sensors.

An extrusion head is properly primed when the coating bead is full and uniform across the extrusion geometry of the extrusion head. Where the extrusion head comprises an extrusion slot, priming is complete when a constant volumetric flow rate is reached across the full length of the slot, and the coating bead is full and uniform across the cross sectional area of the slot.

The priming roller receives the coating material deposited on it, effectively simulating travel of the extrusion head over a distance equal to the linear distance corresponding to the motion of the outside surface of the roller. The roller continuously rotates thereby rapidly exposing the deposited coating material to the solvent which acts to dissolve the coating material. A roller cleaning instrument, preferably a brush or blade, in contact with the roller, preferably underneath the roller so as to avoid interference with extrusion head, acts to remove still more of the coating material from the priming roller. The effect of the solvent bath and the brush, or other material removal device, is to clean the roller thoroughly enough that the portion of the roller surface emerging from the bath is ready to receive more coating material from the extrusion head. This process occurs continuously until the coating bead on the extrusion head is ready for the actual coating operation.

In an alternative embodiment, the required relative motion between a priming surface and the extrusion head could be achieved by various means other than a rotating circular roller including but not limited to a band wrapped around two or more rollers which passes under the extrusion head simulating travel of the extrusion head over a distance of material to be coated. Such a band would operate in much the same way as a treadmill with a parallel set of rollers turning in the same direction driving the band under the extrusion head, into a fluid bath, then preferably into contact with a band cleaning instrument, preferably a brush. The band would continuously revolve thus accomplishing much the same function as the roller although requiring a larger footprint.

Alternatively, a surface for coating fluid deposition could be linearly moved back and forth under the extrusion head with each portion of the surface having coating material thereon being cleaned thereof before being moved back under the extrusion head to receive more coating fluid. Yet another alternative embodiment involves having the extrusion head move with respect to a mostly stationary priming surface wherein portions of the priming surface which have had coating fluid deposited thereon would be cleaned as quickly as possible after such fluid is deposited, thereby preparing this portion of the priming surface for the next pass of the extrusion head.

In a preferred embodiment the fluid used in the priming station is a strong solvent preferably capable of completely dissolving the coating fluid deposited on the priming surface employed for a number of such priming operations. After a preselected number of coating operations, the used solvent in the priming station would be replaced with a fresh supply. Alternatively, the fluid could be chemically inert and merely mechanically aid the brush or other priming surface cleaning device in removing coating fluid from the priming surface. In this case, the fluid used would preferably be lighter than the coating fluid so that the coating fluid would settle at the bottom of a common fluid chamber. Alternatively, the coating fluid could be filtered out of the priming station fluid by appropriate means and stored for later removal from the fluid station and possible recovery or recycling.

In a preferred embodiment, a brush is brought into contact with the priming surface to help remove coating fluid from said surface. A number of other priming surface cleaning mechanisms could be disposed close to, or in contact with, the priming surface including but not limited to a sponge preferably in motion either linearly or angularly with respect to said priming surface, and a sharp edge located in close proximity to the priming surface for scraping away any coating fluid remaining on the priming surface.

Determination as to when to stop the priming process may be made based on a number of conditions including but not limited to the amount of time spent dispensing fluid by the extrusion head over the priming surface, the amount of fluid expended by the extrusion head, and determination by sensor means that the coating bead is ready for an actual coating operation.

In an alternative preferred embodiment, the fluid priming operation can be conducted within the rinsing station or the scrubbing station. Priming the head in this manner requires that the coating fluid be extruded for a preselected period of time, or that a preselected volume of fluid be extruded such that a steady state volumetric flow rate and reliable consistent bead is achieved. In this embodiment, the fluid is extruded into a cleaning station, either the rinser or the scrubber, which absorbs the extruded coating fluid into its solvent pool. The solvent solution is preferably chemically adapted to completely dissolve the extruded coating material. Alternatively, the extruded coating fluid can be segregated from the rest of the fluid in the pool by filtering means or through the ability to separate fluids of different densities.

The function of the priming device is to assist in the preparation and maintenance of an extrusion head by providing a means to normalize (or, achieve a steady state condition) the internal pressures and flow conditions within the extrusion head immediately prior to the application of the coating fluid onto a designated substrate. This is accomplished by dispensing a small amount of the coating fluid out of the orifice of the extrusion head while the head lips (located next to the extrusion orifice) are in close proximity (generally at or very near the actual coating height during substrate coating) to the priming device roller. The roller rotates continuously during this process with the crown of the roller moving at a speed that emulates the relative motion between the extrusion head and substrate during the actual coating process. The roller is precision ground and polished so as to provide a clean and consistent coating surface. The condition of the roller is vital to the effectiveness of the priming process; therefore, a number of cleaning techniques are used in unison to ensure that the deposited coating fluid is completely removed and that the roller is sufficiently clean and dry prior to making a complete rotation back around to the extrusion head lips. Depending upon the characteristics of the coating fluid and its solvent, the roller cleaning action may be accomplished by a combination of some or all of the following techniques.

One embodiment of apparatus and methods for cleaning a roller subjected to low-to mid-viscosity fluids is: rotation of the roller through a solvent bath, a doctor blade (wet scraper) submerged in a solvent bath for bulk coating fluid removal, an array of nozzles that spray clean solvent across the roller after submergence in the solvent bath, a dry doctor blade (dry scraper) for solvent removal after spraying the roller priming surface and exhaust driven airflow for final solvent removal/drying.

One embodiment of apparatus and methods for cleaning a roller priming surface subjected to high-viscosity fluids, in addition to or instead of some of the features listed above is: a vertical doctor blade (scraper) for bulk removal of the coating fluid (prior to solvent soak), and/or an auger-based system for removal of the waste material from the priming device.

An internal overflow and drain are built into the priming device trough to control the level of the solvent bath and prevent overfill during spraying or solvent replenishment operations. Additionally, specialty non-stick or non-wetting coatings may be applied to the surfaces of the priming device trough to assist in the cleaning process (this feature is more useful for process fluids that are staining or otherwise difficult to clean). To assist in the general maintenance and serviceability of the priming device unit, the roller, bearings, and bearing block can be easily removed from the trough as a single unit. The bearing blocks in the roller bearing end seal assembly are also designed to serve as a stand for the roller to help prevent possibly damaging contact with the roller's precision surface once it has been removed from the priming device unit. The bearing blocks also have integral locating features to assist in accurate reassembly. The doctor blades are removable as assemblies, further facilitating roller removal and trough access for cleaning, etc.

In some cases, the roller may be treated with a specialty coating to modify the wetting characteristics of the roller surface. The roller surface is then in a condition where it can be coated initially by the extrusion head, but then the coating fluid starts to "bead up" on the surface of the roller. This allows the coating fluid to be more easily removed from the roller and allows the roller to be more easily dried of solvent.

The priming device assembly is designed to be "modular" in length which allows different sizes of the priming device to be manufactured using many of the same components, in different quantities. For example, the 550 mm priming device uses 2 sprayer block/exhaust assemblies (see FIG. 1); the 880 mm priming device uses 3 of these assemblies, and the 1200 mm priming device uses 4 of these same assemblies. The priming device is designed to allow for very long lengths, thus accommodating the large extrusion heads necessary in leading edge display production. Versions of up to 2000 mm are available with this same priming device concept.

Therefore, it is a technical advantage of the present invention that an extrusion head can be automatically cleaned by bringing the head into proximity of one or more cleaning stations which occupy a minimal footprint within, or in proximity to, a coating apparatus.

It is a further technical advantage of the present invention that different cleaning operations may be employed depending upon such factors as the viscosity and chemical composition of the fluid to be removed.

It is a still further technical advantage of the present invention to provide a priming mechanism to ensure that a steady state flow condition and proper coating bead exist at the extrusion head before a coating operation is undertaken.

It is a still further technical advantage of the present invention that properly priming the bead at the extrusion head can prevent leading edge anomalies when coating a substrate.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawing, in which.

DETAILED DESCRIPTION

Figure 1:
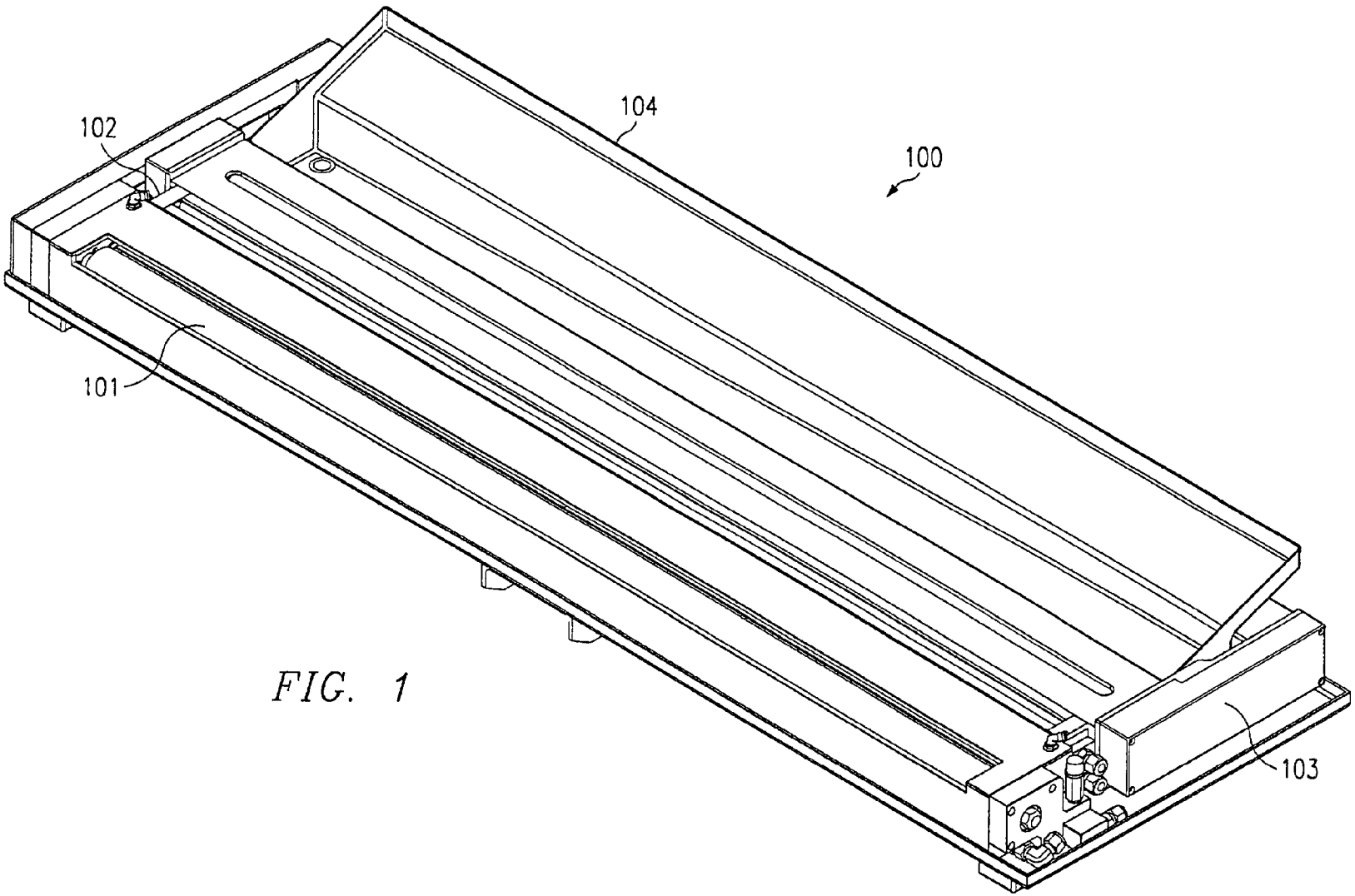
FIG. 1 depicts a perspective view of a cleaning and priming assembly according to a preferred embodiment of the present invention.

FIG. 1 depicts a perspective view of a cleaning and priming assembly according to a preferred embodiment of the present invention. In this embodiment the cleaning and priming assembly 100 comprises a first cleaning station consisting of a scrubber 103, a second cleaning station consisting of a rinser 102, and a priming device or station 101, and a service trough 104. The service trough 104 is preferably used to perform maintenance and/or cleaning on an extrusion head, coating head, or dispensing head which cannot be performed at the priming or cleaning stations.

The order of the stations as shown in FIG. 1 is convenient in that an extrusion head or other type of dispensing head can start at the scrubbing station 103, and continue to move in the direction away from the service trough 104 and finish with the priming operation at the priming station 101. No particular mechanical arrangement of the devices is required however. The various stations may be arranged in any order convenient to the treatment of a particular extrusion head or suitable for a particular coating operation.

Figure 2:
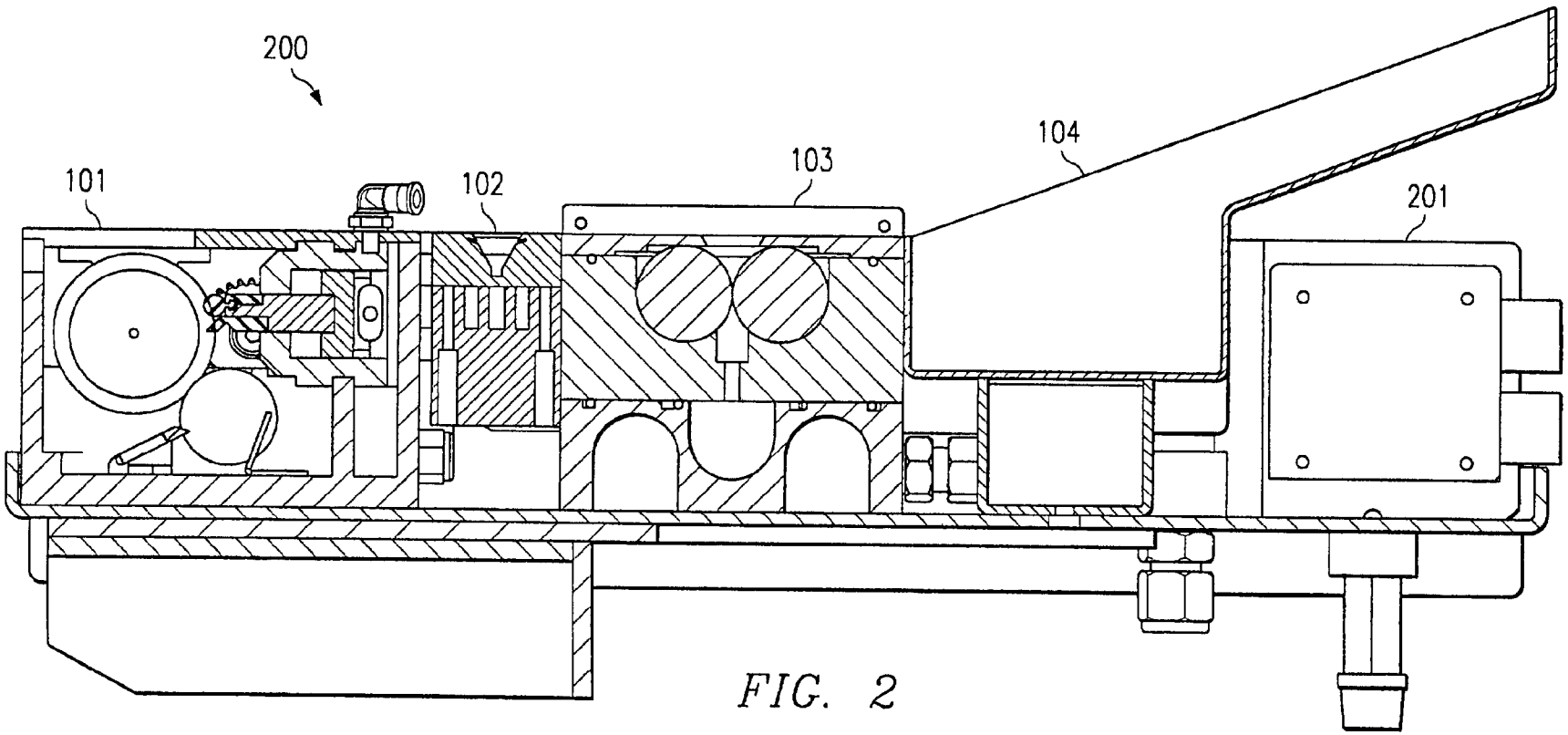
FIG. 2 depicts a sectional view of a cleaning and priming assembly according to a preferred embodiment of the present invention.

FIG. 2 depicts a sectional view of a cleaning and priming assembly 200 according to a preferred embodiment of the present invention. The stations are arranged in the same order as in FIG. 1 wherein proceeding from right to left there is the service trough 104, scrubbing station 103, rinsing station 102, and priming station 101. Drive means or motor 201 of the preferred embodiment is shown at the far right. In a preferred embodiment, the scrubbing, rinsing, and priming stations all receive the power required of their respective operations from a single common drive means. Each station would then employ appropriate mechanical coupling to connect the main source of mechanical power to the rotating means in the scrubbing and priming stations and to fluid pumping means in the rinsing and scrubbing stations. Alternatively, each station within the cleaning and priming assembly 100 could have separate and independent drive means. Various permutations permitting a number of different combination of devices to be used with a combination of different drive means can be implemented without departing from the present invention.

Figure 3:
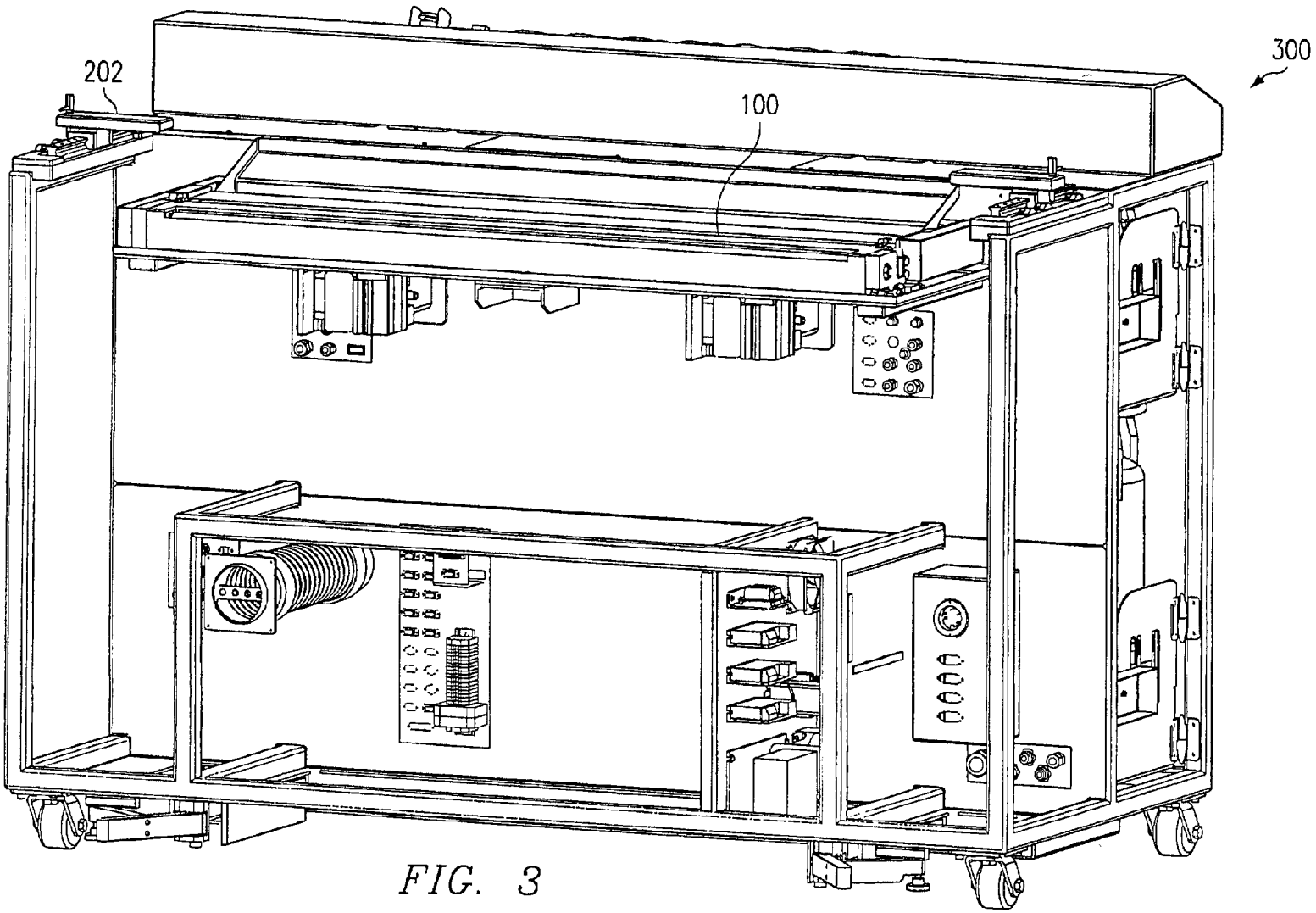
FIG. 3 depicts an implementation of the cleaning and priming assembly according to a preferred embodiment of the present invention.

FIG. 3 depicts an implementation of the cleaning and priming assembly 100 according to a preferred embodiment of the present invention. In one possible embodiment of a coating apparatus, the wet components of a coating apparatus are disposed on a fluid cart which is removably attachable to a station containing the balance of the equipment of a coating apparatus as described in detail in the above referenced patent application entitled "SYSTEM AND METHOD FOR INTERCHANGEABLY INTERFACING WET COMPONENTS WITH A COATING APPARATUS". In this situation, the cleaning and priming assembly 100 is preferably disposed on the fluid cart as shown in FIG. 3. In this embodiment, the characteristics of the cleaning and priming assembly can be configured with a particular extrusion head and with particular coating fluid in mind, since both the coating fluid and extrusion or dispensing head are associated with a particular fluid cart 300.

Variations in the present invention possible once the extrusion head and coating fluid are identified include a determination as to whether a scrubbing station is necessary, since scrubbing stations tend to be used for more viscous fluids. If a scrubbing station is to be included, the dimensions of the scrubbers and the proximity with which opposing scrubbers are placed to each other can be adjusted to suit the dispensing head. The dimensions of the rinsing station can be similarly adjusted to suit the extrusion head to be used at that station. Further, the selection of solvents at all of the scrubbing, rinsing and priming stations can be selected for maximum effectiveness once the coating fluid to be dissolved by them is identified. The present invention is not limited to being used on the fluid cart however. In an alternative embodiment of the coating apparatus comprising a removably attachable fluid cart, the cleaning and priming stations 100 could be placed on the station comprising the chuck which holds the substrate to be coated, for example, and used along with a variety of different extrusion heads and coating fluids.

The invention may be implemented with a wide range of configurations of coating apparatuses and is in no way limited to being implemented on the fluid cart of the preceding discussion. In an alternative preferred embodiment, the coating apparatus may be single piece of equipment. Accordingly, the cleaning and priming assembly may be physically integrated into the construction of a coating apparatus structure. Alternatively, the cleaning and priming assembly may be physically independent of the chuck, extrusion head, and fluid delivery system, although located nearby in a position accessible to the extrusion head.

In a preferred embodiment, the cleaning and priming assembly is stationary, at least during the execution of a single coating operation, and the head is moved over the cleaning and priming assembly, approaching and entering each station as the needs of the particular head and coating operation dictate. In this embodiment, the cleaning and priming assembly would be located outside the range of extrusion coating travel over a substrate supported by a chuck. At selected times, such as in between coating operations, a mechanism would move the head outside the range of coating operation in order to access the cleaning and priming assembly.

Figure 15:
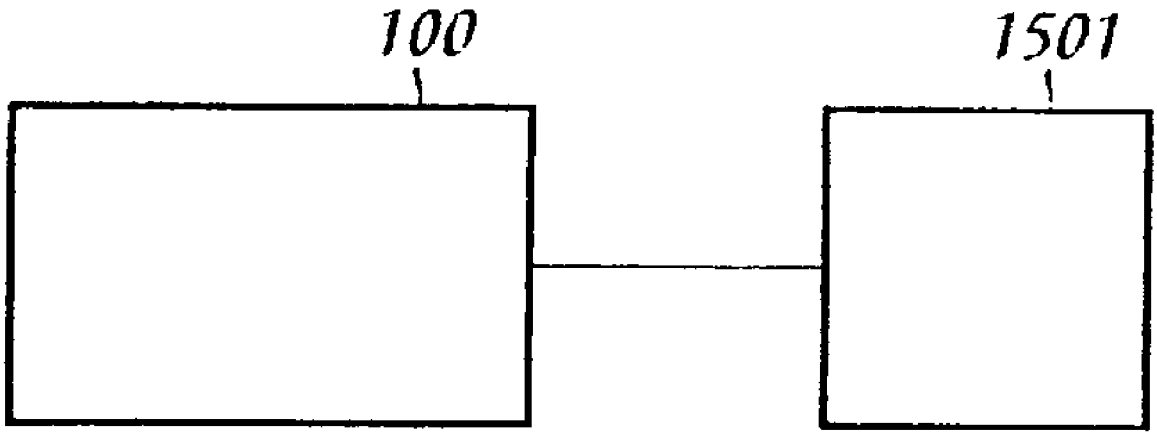
FIG. 15 depicts a means for moving assemblies for preparing the extrusion head according to a preferred embodiment of the present invention.

In an alternative embodiment, the cleaning and priming assembly is moved into the range of coating operation travel of the extrusion travel when the head needs cleaning and/or priming, and removed from this range of travel when the head is ready to begin a coating operation. With this embodiment, the assembly would only have to assume two positions: one for servicing the head, and a second for being placed out of the way of the coating operation. The required motion of the cleaning and priming assembly 100 (See FIG. 15) could be accomplished by a number of moving means 1501 (FIG. 15) including but not limited to a shuttle attached to one or more air cylinders, an electric motor, hydraulic, and manual operation.

The need for relative motion between the extrusion head and the cleaning and priming station need not be met by moving only one of the two entities. A number of configurations are possible in which some combination of motion, possibly comprising a combination of linear and angular motion, of both the cleaning and priming assembly and the extrusion head with respect to each other is employed in order to bring the two together for servicing of the extrusion head, and to bring them sufficiently far apart to permit the coating operation to proceed without interference from the cleaning and priming assembly. Such a combination of assembly or station movement and extrusion head movement, as well as combination of linear motion and angular motion is employed in an alternative embodiment discussed in the following section.

Figure 4:
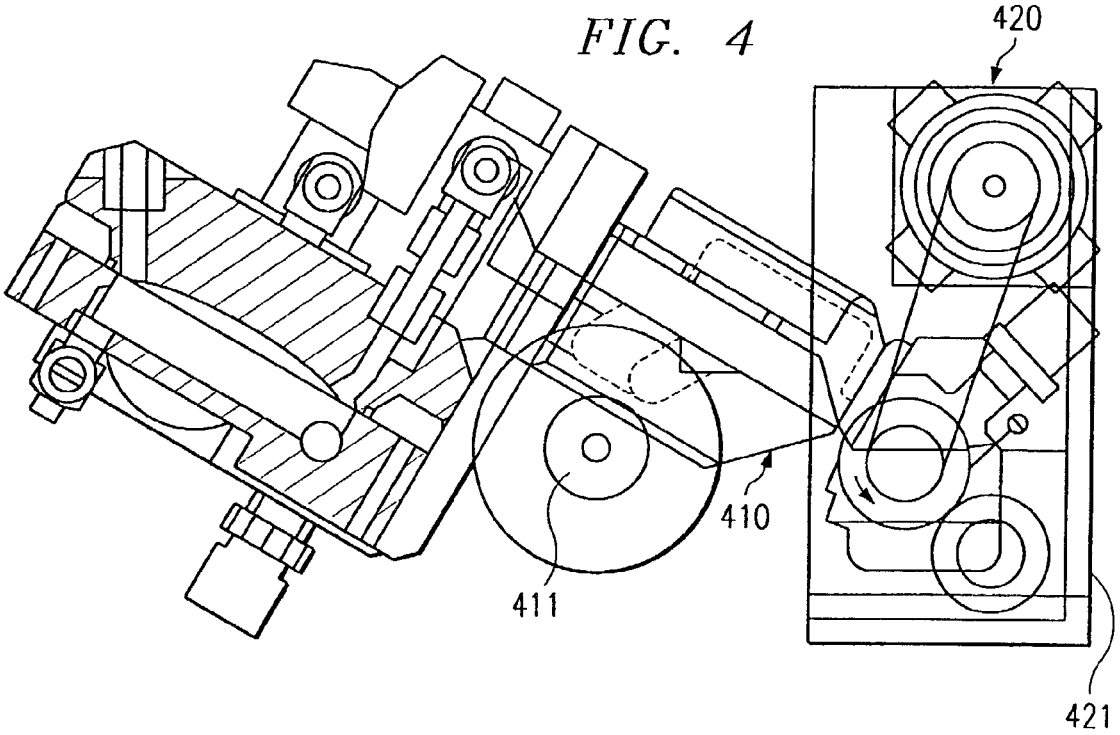
FIG. 4 depicts an implementation of the cleaning and priming assembly in proximity to an extrusion head according to an alternative embodiment of the present invention.

FIG. 4 depicts an implementation of the cleaning and priming station 420 in proximity to an extrusion head 410 according to an alternative embodiment of the present invention. In this embodiment, extrusion head 410 accesses the priming station 420 by rotating the extrusion head 410 about an axis 411 until the dispensing slot of the extrusion head is in proximity to the priming roller 421. The priming station 420 is preferably moved along a linear axis between a priming position and a coating position. During coating, the priming station 420 is moved to the right, to its coating position, in the configuration of FIG. 4 so as not to interfere with coating by extrusion head 410. In anticipation of priming, the priming station 420 is moved to its priming position (toward the left in the configuration of FIG. 4) so as to be accessible to the extrusion head 410 for priming the coating bead.

Figure 5:
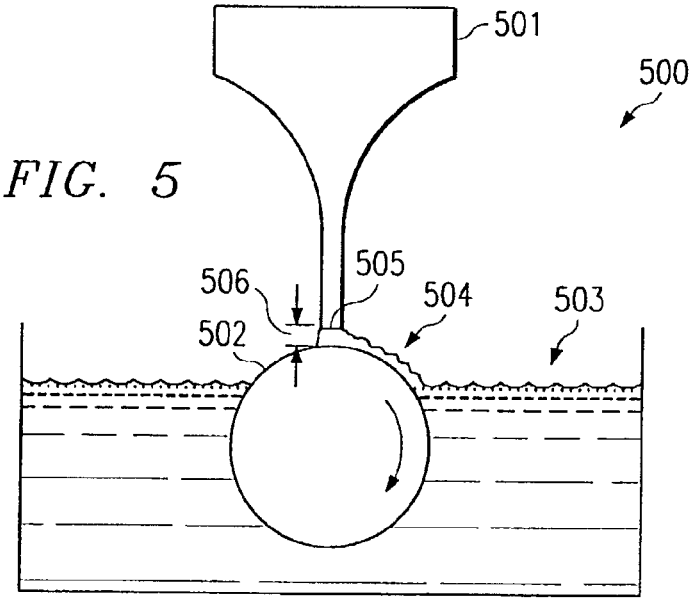
FIG. 5 depicts an elevation view of an extrusion head in proximity to a priming device according to a preferred embodiment of the present invention.

FIG. 5 depicts an elevation view 500 of an extrusion head 501 in proximity to a priming device according to a preferred embodiment of the present invention. Extrusion head 501 extrudes coating material 504 onto priming roller 502 immersed in fluid bath 503. The fluid bath 503 acts to clean the surface of the priming roller 504 as it immerses coating fluid 504 deposited on the roller 502 into the fluid bath 503. A plurality of mechanical devices (not shown) acts to further clean the priming roller 502 as it rotates within the fluid bath 503. The extrusion head 501 is properly primed when the bead of coating fluid or material is full and uniform across the extrusion geometry, or extrusion slot 505, of the extrusion head.

The gap between the extrusion slot 505 on the extrusion head 501 and the nearest point on the roller 502 is kept as close as possible to the head gap between the extrusion head slot and a substrate when performing an actual coating operation. Carefully preserving the dimension of the gap 506 preserves the accuracy of the simulation of coating activity occurring during priming of the head.

Extrusion of the coating fluid 504 from the extrusion head 501 preferably continues until a set of conditions previously determined to indicate that a proper coating bead is present at the point of extrusion are satisfied. Preferably, the condition for concluding the priming operation is lapsing of a predetermined period of time. Alternatively, the condition for concluding priming is the extrusion of a predetermined volume of fluid. The parameters used to determine conditions for concluding the priming operation may include but are not limited to the width of the extrusion slot 505, the viscosity of the coating fluid 504, and the head gap between the extrusion head and substrate to be employed in the coating operation to follow.

Another option for determining completion of the priming process involves sensing the existence of a full coating bead using sensing mechanisms within the extrusion head 501 including but not limited to a vision system disposed to view the coating bead, or contact or pressure sensors within the extrusion head. Another mechanism for determining completion of the priming process involves sensing the coating on the roller 502 or other priming surface employing a vision system or contact sensors. Determination that the coating material 504 on the roller 502 is in proper form would be used to conclude that the priming of the extrusion head is successfully completed.

Figure 6A:
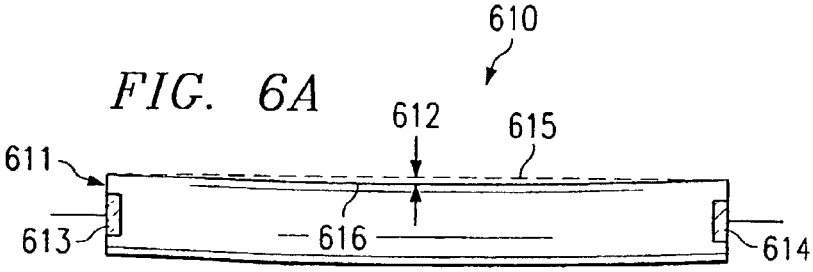
FIG. 6A depicts a side view of a priming roller according to a preferred embodiment of the present invention.
Figure 6:
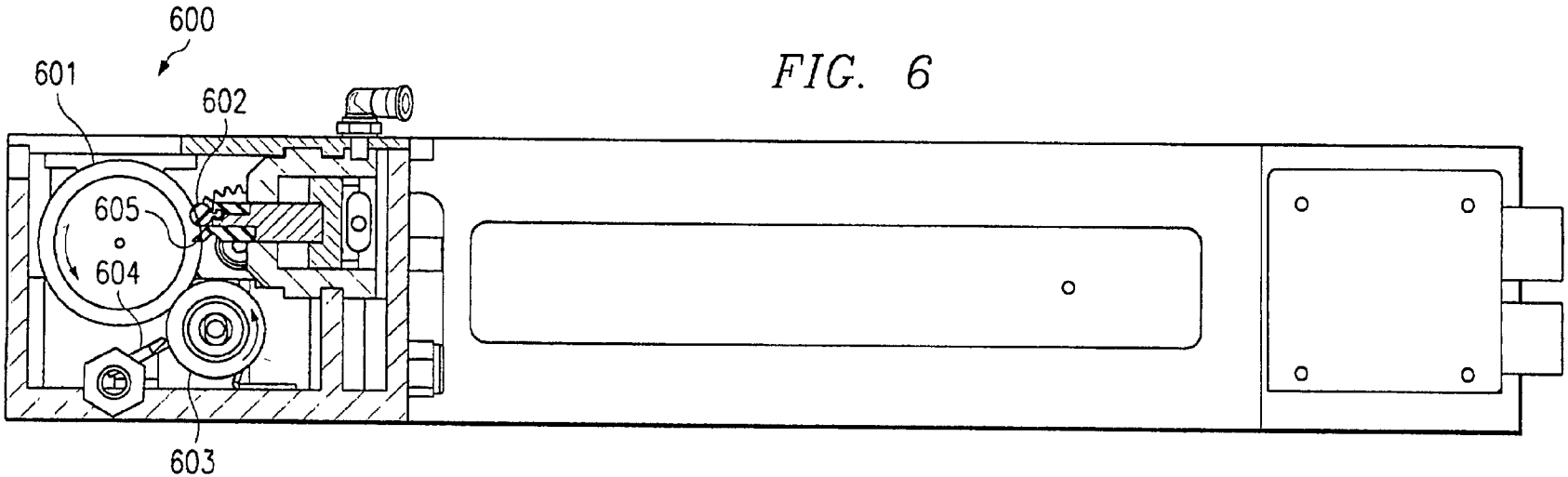
FIG. 6 depicts a section view of a priming station according to a preferred embodiment of the present invention.

FIG. 6 depicts a section view of a priming station according to a preferred embodiment of the present invention. The priming roller 601 is immersed in a bath of solvent and rotates clockwise in the view presented in FIG. 6. The extrusion head (not shown) is placed above the roller 601 preferably at a height above the roller as close as possible to the height of the extrusion head above the substrate to be coated in the next coating operation. The roller 601 receives coating material from the extrusion head as the top of the roller rotates toward the brush 603. The brush 603 acts to remove most of the coating material from the roller 601. The point on the roller which has gone past the brush 603 then encounters the scraper 605 which preferably removes almost all remaining coating material from the part of the roller 601 with which it is currently in contact. Coating material removed from the roller 601 by the brush 603 and the scraper 605 is dispersed into the solvent bath (not shown) and gradually dissolved into said bath. The point on the roller 601 which has passed the scraper 605 in its counterclockwise rotation (in the view of FIG. 6) then encounters the wiper 602 which preferably removes substantially all remaining solvent from that point on the roller 601.

The brush 603, in addition to rotating against the roller 601, also rotates, preferably in the same direction as the priming roller 601 (here counterclockwise) against a blade 604 which preferably removes any coating material still adhering to the brush 603, so that the portion of the brush which has rotated past the blade 604, is clean enough to effectively remove material from the roller which a point on the perimeter of the brush 603 will contact after rotating past the blade 604.

Preferably, any residual coating material remaining on a point of the perimeter of the roller 601 which has rotated past the brush 603, scraper 605, and wiper 602 is dissolved in the solvent bath before that point again receives coating material from an extrusion head. Although it is preferable that the point on the priming roller 601 which is about to receive coating fluid from the extrusion head be completely free of coating fluid, the priming station will generally operate effectively even if some small amount of coating fluid remains. The brush 603, scraper 605, wiper 602, and immersion in the solvent bath will prevent any disruptive buildup of coating material on the roller, and between them preferably remove nearly all coating fluid on the roller.

The description of FIG. 6 centers on a rotating cylindrical priming roller. The invention however, is not limited to this embodiment. In various alternative embodiments the required relative motion between a priming surface and the extrusion head could be achieved by various means other than a rotating circular roller including but not limited to a band wrapped around two or more rollers which passes under the extrusion head simulating travel of the extrusion head over a distance of material to be coated. Such a band would operate in much the same way as a treadmill with a parallel set of rollers turning in the same direction driving the band under the extrusion head, into a fluid bath, then preferably into contact with a band cleaning instrument, preferably a wiper and/or a brush. The band would continuously revolve thus accomplishing much the same function as the roller although requiring a larger footprint.

Alternatively, a surface for coating fluid deposition could be linearly moved back and forth under the extrusion head with each portion of the surface having coating material thereon being cleaned thereof before being moved back under the extrusion head to receive more coating fluid. Yet another alternative embodiment involves having the extrusion head move with respect to a mostly stationary priming surface wherein portions of the priming surface which have had coating fluid deposited thereon would be cleaned as quickly as possible after such fluid is deposited thereby preparing this portion of the priming surface for the next pass of the extrusion head.

In a preferred embodiment, the fluid used in the priming station is a strong solvent capable of completely dissolving the coating fluid deposited on the priming surface employed for a number of such priming operations. After a preselected number of coating operations the used solvent in the priming station would be replaced with a fresh supply. Alternatively, the fluid could be chemically inert and merely aid the brush or other priming surface cleaning device to remove coating fluid from the priming surface. In this case the fluid used would preferably be lighter than the coating fluid so that the coating fluid would settle at the bottom of a common fluid chamber. Alternatively, the coating fluid could be filtered out of the priming station fluid by appropriate means and stored for later removal from the fluid station and possible recovery or recycling.

In the embodiment of FIG. 6, cleaning of the priming surface, in the form of a priming roller 601, is accomplished by a combination of a brush 603, a scraper 605, and a wiper 602. The invention is not limited to these priming surface cleaning means, however. A variety of other priming surface cleaning mechanisms could be disposed close to, or in contact with the priming surface including but not limited to a sponge preferably in motion either linearly or angularly with respect to said priming surface, blades, high pressure fluid jets, or wipers.

In the embodiment of FIG. 6, cleaning of one of the priming surface cleaning means, the brush 603 is accomplished via the use of a blade 604 disposed so as to scrape residual coating material off the brush. A variety of means for cleaning mechanisms which in turn clean the priming surface could be deployed, including but not limited to brushes, blades, cylindrical or otherwise shaped sponges, high pressure fluid jets, or wipers.

In another preferred embodiment of the invention, priming of the extrusion head can take place within one of the extrusion cleaning stations thereby obviating the need for a separate priming station. This will be discussed in more detail in the sections describing the extrusion head cleaning stations.

FIG. 6A depicts a side view 610 of a priming roller 611 according to a preferred embodiment of the present invention. In order to match anticipated sag in a dispensing head which would increase with distance from the two ends of the dispensing head, it is desired to have a roller also sag in the middle either as a result of mechanical design or as a consequence of the locations at which the roller is supported.

FIG. 6A depicts a view of a roller 611 which sags as a result of its weight and the fact of it being supported primarily at points 613 and 614. The effect of gravity is to cause the roller 611 to deflect or sag along virtually all of its length except where rigidly supported at points 613 and 614. The sag or deflection increases along the length of the roller 601 with increasing distance from the points of support 613 and 614. The sag can be visualized by observing the distance at any point along the length of the roller 611 between dotted line 615 and solid line 616. Dotted line 615 is a straight line representing the height points along the upper surface of the roller 611 would be at if the roller were perfectly rigid and its upper surface therefore, perfectly straight. Although there is sag along almost the entire length of the roller, the maximum deflection or sag in the roller 601 occurs at a point substantially equidistant from the points of support and is labeled 612 in FIG. 6A.

In a preferred embodiment, the materials, properties and dimensions of the roller 611 can be selected to provide for sag which will match the anticipated sag in a dispensing head to be placed over the roller 611 as closely as possible. Methods of modifying the sag in the roller once it is constructed include, but are not limited to applying force along the axis of the roller from both sides in either a compressive or tensile manner (pushing or pulling on the two ends along the axis of the roller), and supporting the roller 611 from below at various points along its length.

Figure 16:
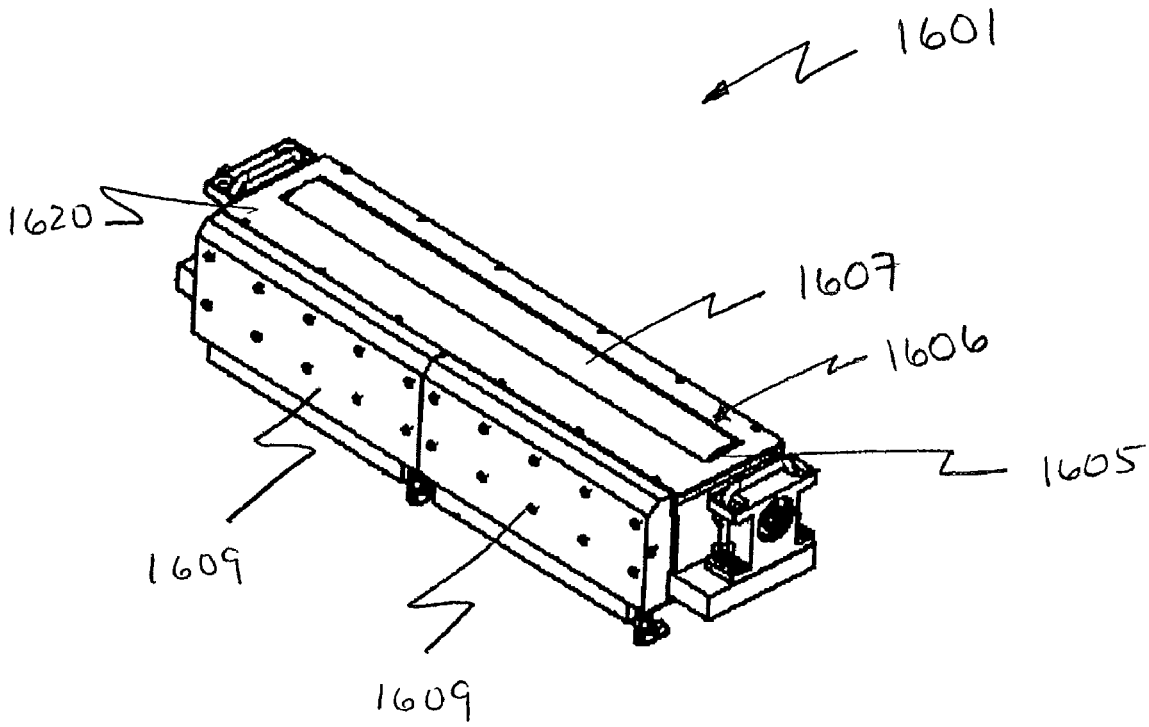
FIG. 16 depicts an isometric view of a priming device according to a preferred embodiment of the present invention.
Figure 16A:
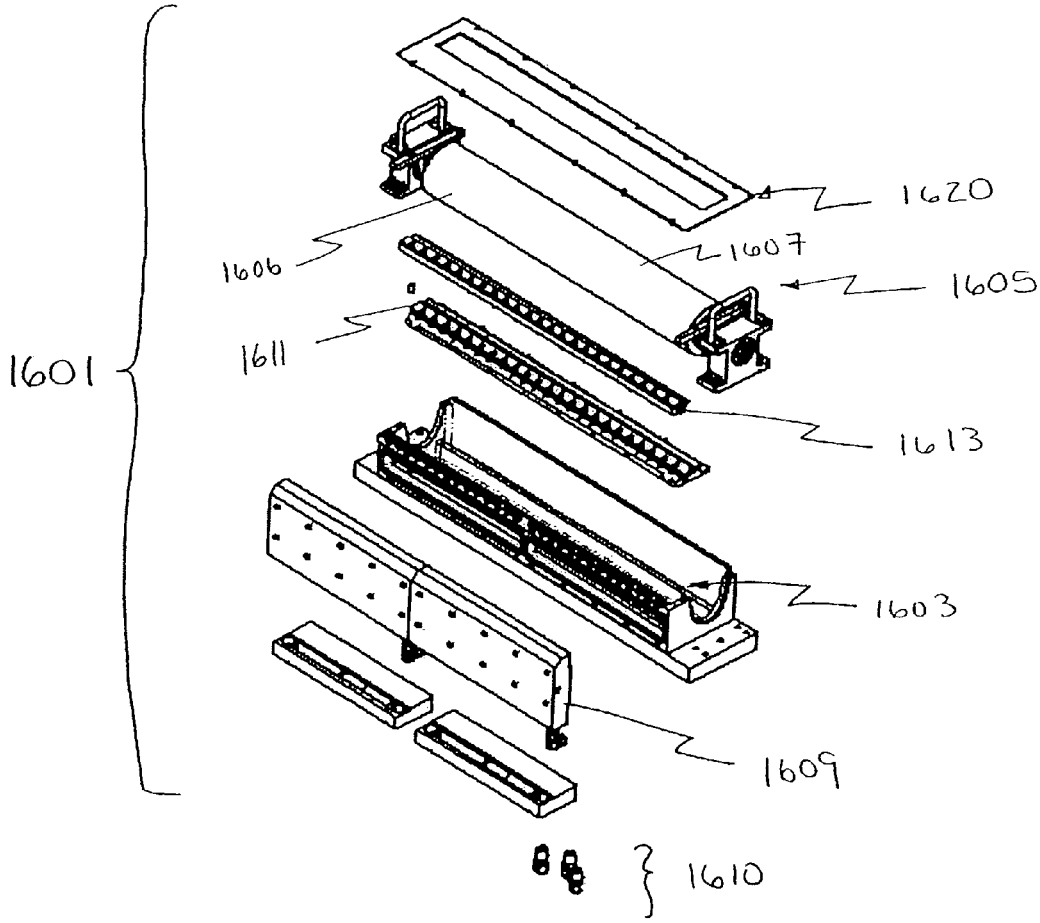
FIG. 16A depicts an exploded view of a priming device according to a preferred embodiment of the present invention.

FIG. 16 and FIG. 16A are views of another embodiment of the priming device of the present invention, generally depicted by the numeral 1601. Priming device 1601 includes a trough 1603, a priming roller 1605 having an outer priming surface 1606 and a crown 1607, a wet scraper 1611, a dry scraper 1613 and an exhaust assembly 1609. These elements are representative components of a priming device that may include fewer elements or additional elements. As shown in FIG. 16, crown 1607 is a portion of priming surface 1606 that is the highest point of the priming surface providing access for the extrusion head for priming. Once enclosed a solvent may be disposed, and a substantially constant level maintained, within trough 1607. Desirably priming device 1601 includes a cover 1620.

Figure 17:
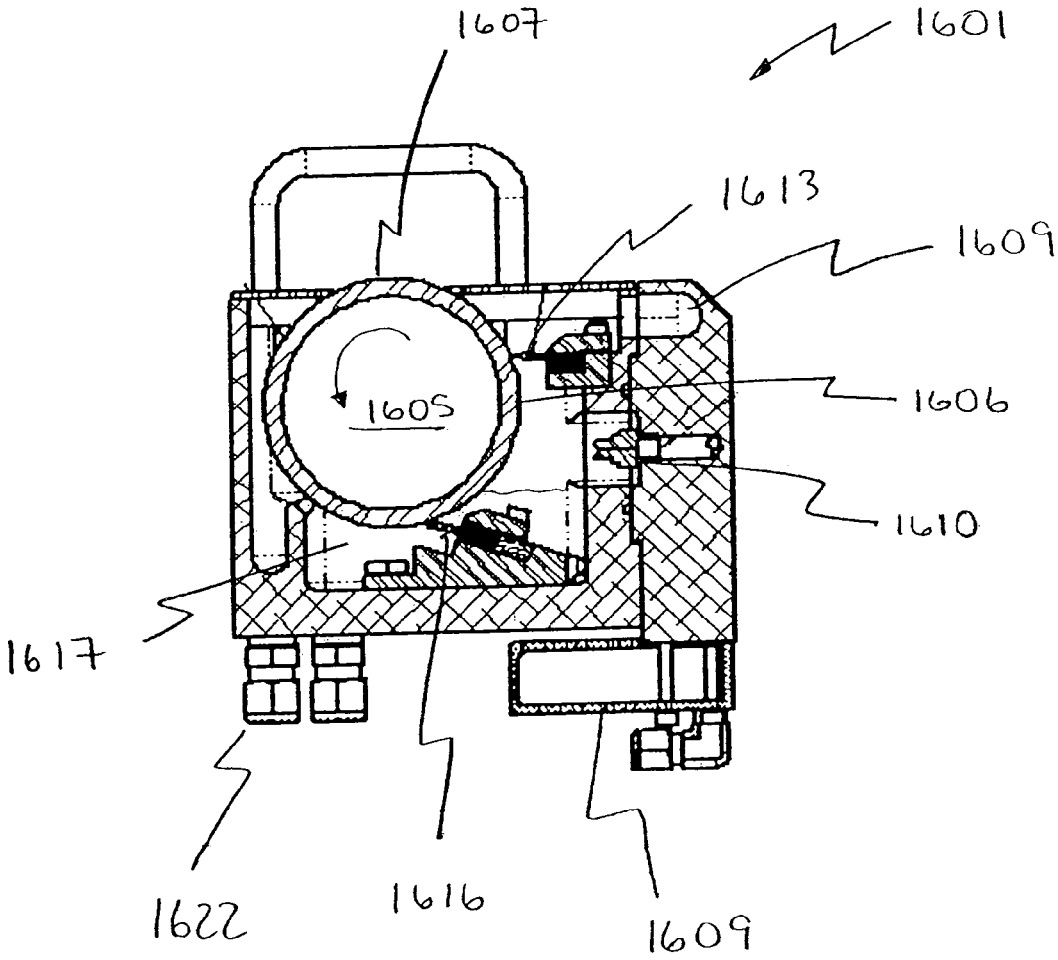
FIG. 17 depicts a partial cross-sectional, end view of a priming device according to a preferred embodiment of the present invention.

FIG. 17 is a representative view of a priming device 1601 utilized for priming an extrusion head with low to mid viscosity coating fluids. Roller 1605 is shown rotating in a counter-clockwise direction by the arrow. Priming device 1601 is adapted for positioning proximate an extrusion head. The extrusion head, as previously described is positioned proximate crown 1607 of roller 1605. As roller 1605 rotates, priming surface 1606 is rotated from the crown position through priming device 1601 for cleaning before reaching crown 1607 for continuously priming the extrusion head. As represented in FIG. 17 priming surface 1606 is cleaned first by passing through a solvent pool or bath 1617 maintained in trough 1603. Ports 1622 or other means may be utilized to maintain a substantially constant level of solvent pool 1617. As priming surface 1606 moves through solvent pool 1617 coating material is removed. It may further be desired to have a wet scraper 1616 in contact with priming surface 1606 and disposed in or proximate the solvent pool 1617 to aid in removal of coating material. After passing through solvent bath 1617 it may be desirable to spray a clean solvent via nozzle(s) 1610 onto priming surface 1606 to remove contaminated solvent from surface 1606 thus rinsing it clean. It is then desirable to dry surface 1606 before reaching crown 1607 for further priming of the extrusion head. If the surface does not dry it may be desired to utilize a dry scraper 1613 and/or exhaust system 1609 to pass air across surface 1606. Dry scraper 1613 is placed after nozzles 1610 relative to the rotation of the roller and is in contact with surface 1606.

Figure 18:
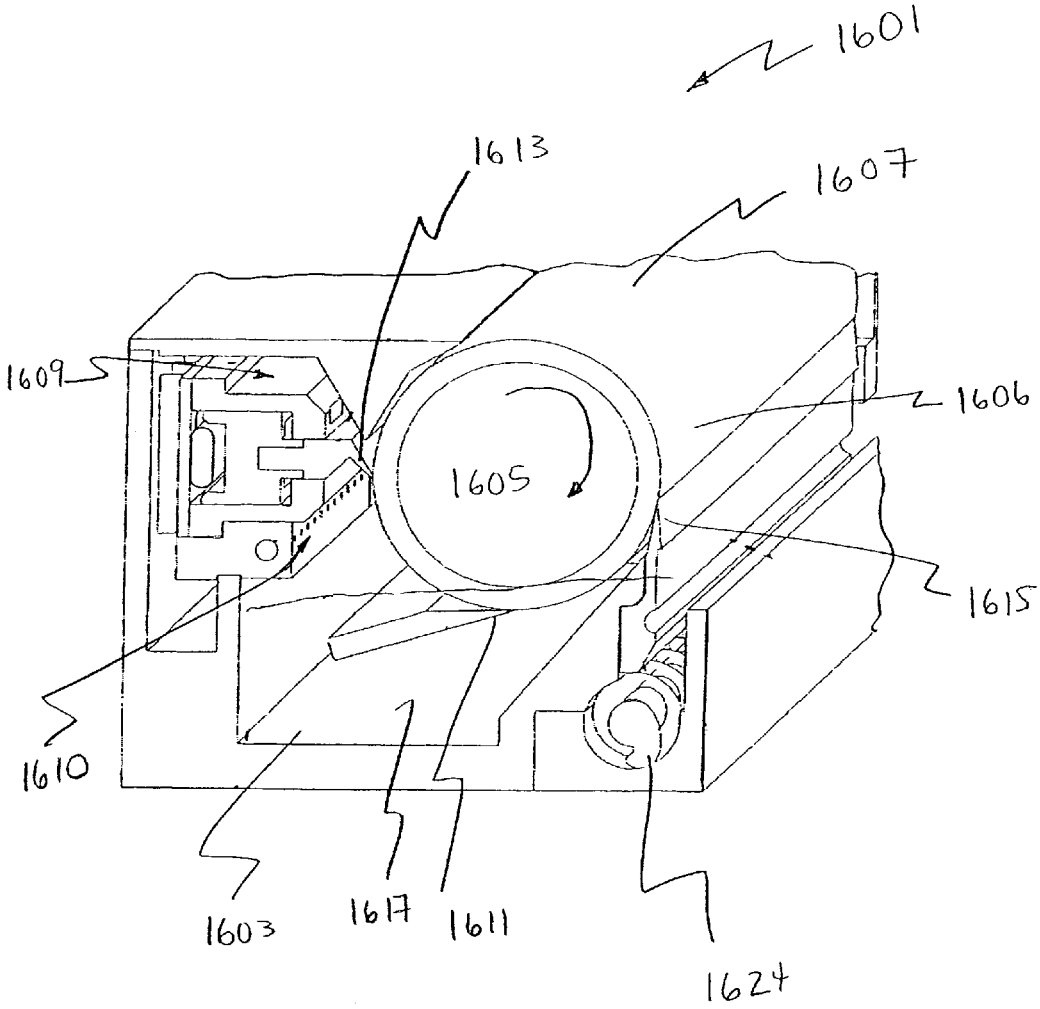
FIG. 18 depicts a partial view of a priming device according to a preferred embodiment of the present invention.

FIG. 18 is a representative view of priming device 1601 for priming an extrusion head utilizing a high viscosity fluid. Roller 1605 is shown rotating in the clockwise direction. After coating fluid is extruded onto coating surface 1606 at crown 1607 is rotates by a substantially vertical scraper 1615 for bulk removal of coating fluid. The priming surface is then rotated though solvent bath 1617, which may include a wet scraper 1611. Priming surface 1606 may then pass though a solvent spray from nozzles 1610. To dry surface 1606, priming device may include a dry scraper 1613 and/or exhaust system 1609. When utilizing high viscosity fluids it may be desirable to include a waste removal system 1624 to clean material from trough 1603 and solvent pool 1617. One demonstrated waste removal system 1624 is represented by an auger in functional connection with trough 1603 to prevent excess loss from solvent bath 1617 while removing excessive waste material.

As previously described it is desired to rotate roller 1605 at a speed such that the linear speed of crown 1607 approximates that of the relative speed of the extrusion head and the substrate during the coating operation. It is further desirable to position the extrusion head above crown 1607 for priming a distance approximating the distance between the extrusion head and the substrate during the coating process.

A description of a method of priming an extrusion head is positioning the extrusion head over the crown of the roller, at a height approximating that which will subsequently be used for coating the substrate. The height is set using a precision vertical motion device, based on distance measurements from mechanical or optical sensors. The roller is rotated at a fixed rate so that the linear speed of the crown is approximately that of the relative speed between the extrusion head and the substrate during coating. While the roller is rotating coating fluid is dispensed from the extrusion head onto the surface of the roller for a period sufficient to normalize pressures and flow conditions inside the head and in the coating bead. The primary goal is to establish a steady state coating condition that is identical or very close to the actual coating condition that will occur on the substrate. Once this steady state condition is reached the extrusion head will be moved quickly from the priming device to the leading edge of the substrate to start the coating process. As the roller is turning the coated surface moves through a solvent bath that begins to dissolve the coating fluid and remove it from the roller surface. A wet blade or scraper may be submerged in the solvent bath to physically scrape most of the coating fluid from the roller surface. The roller then rotates past an array of solvent sprayers that remove any remaining contaminated solvent residue from the roller surface. Following the sprayers is a dry blade or scraper that wipes the roller clean of any solvent drops. Finally the roller passes by an exhaust port that uses airflow to complete the drying of the roller and capturing any solvent vapors prior to the roller completing its revolution. Since the above steps occur continuously as the roller is rotated the priming process can essentially continue indefinitely.

Figure 7:
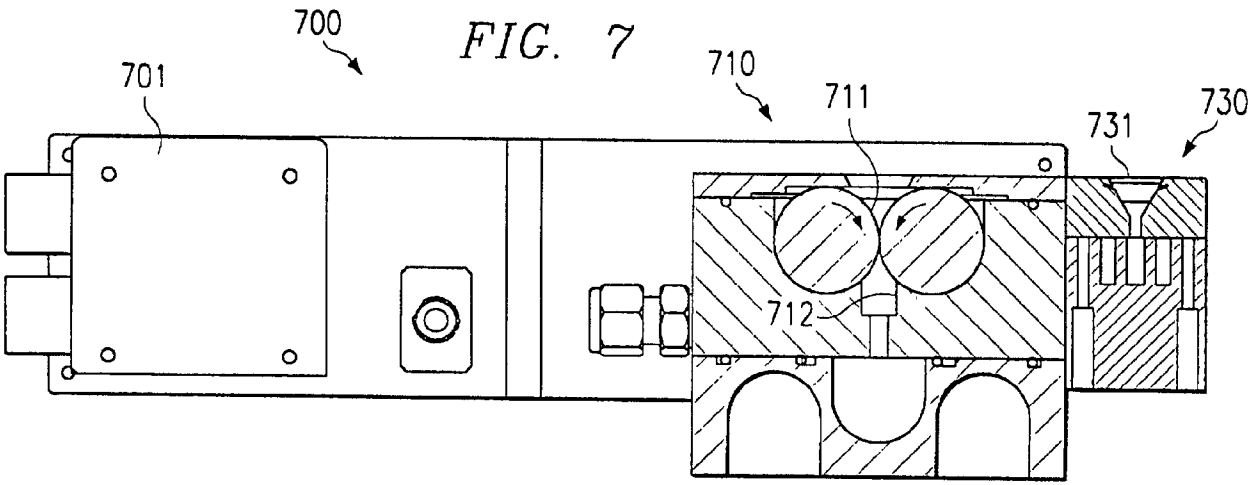
FIG. 7 depicts a section view of an extrusion head cleaning assembly according to a preferred embodiment of the present invention.

FIG. 7 depicts a section view of an extrusion head cleaning assembly according to a preferred embodiment of the present invention. In a preferred embodiment, the cleaning assembly 700 comprises a scrubbing station 710 and a rinsing station 730 preferably both attached to a common drive means or motor 701. For the rinsing station 730, connection to the drive means 701 relates to means for driving a pump for circulating rinsing solvent within the rinsing station 730.

The scrubbing station 710 preferably comprises two cylindrical brushes 711 which make contact with the two outside surfaces of the extrusion head (not shown) immersed in a fluid bath (not shown) preferably comprising a strong solvent. The two brushes 711 preferably rotate in opposite directions, which in the view of FIG. 7 comprises having the left scrubber rotate clockwise and the right scrubber rotate counterclockwise, thereby directing coating material removed from the extrusion head by both brushes 711, when the extrusion head is disposed between the two brushes 711, toward a region in between and below the brushes 711. The removed coating material is preferably then dissolved in the solvent bath.

Each brush 711 in the scrubbing station 710 preferably rotates against a brush cleaning instrument, preferably a blade or other solid member disposed so as to contact the brush as it rotates thereby removing coating fluid from each brush on an ongoing basis. Coating material removed in this manner is preferably carried away by a stream of solvent and dissolved in the solvent bath. The solvent is preferably treated and filtered in-process so as to keep the chemical strength of the solvent at a level sufficient to continue the process of dissolving the coating material removed from the extrusion head. Alternatively, the dissolved material could remain dissolved in the scrubbing station solvent until the solvent is replaced.

The rinsing station 730 comprises a cleaning groove 731 into which the extrusion head (not shown) is placed during the rinsing process, a fluid reservoir, and a fluid delivery system for achieving total coverage of the surface to be cleaned on the extrusion head. The rinsing station is discussed in greater detail in a subsequent section.

Figure 8:
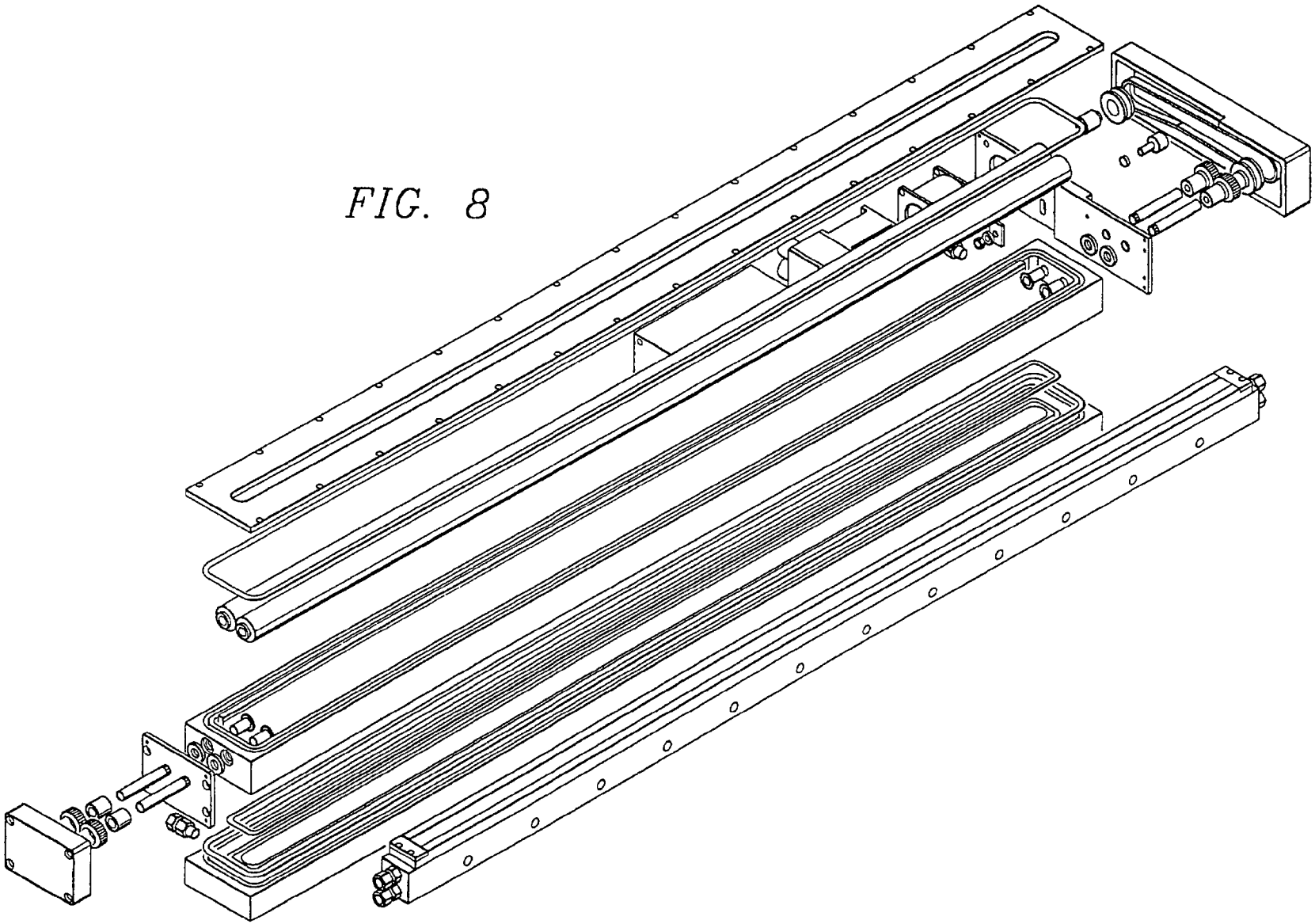
FIG. 8 depicts an exploded view of parts of an extrusion head scrubbing station according to a preferred embodiment of the present invention.
Figure 9:
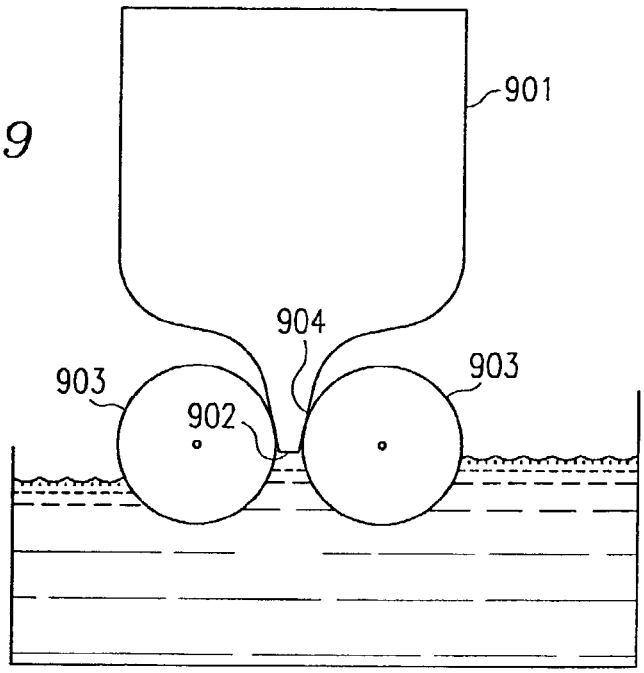
FIG. 9 depicts an extrusion head in cleaning position within a scrubbing station according to a preferred embodiment of the present invention.

FIG. 8 depicts an exploded view of parts of an extrusion head scrubbing station according to a preferred embodiment of the present invention;

FIG. 9 depicts an extrusion head 901 in cleaning position within a scrubbing station according to a preferred embodiment of the present invention. The extrusion head 901 is shown in cleaning position next to the scrubbing instruments 903 which are in contact with the surface to be cleaned 904 on the extrusion head 901.

In a preferred embodiment, the scrubbing instruments 903 are brushes and two such brushes are used, one on either side of the extrusion head 901. Alternatively, any number of scrubbing instruments 903 could be used and disposed so as to contact the surface to be cleaned 904 at various points along the exterior surface of the extrusion head 901. The number of scrubbing instruments deployed on the two sides of the extrusion head need not be the same.

In a preferred embodiment, the scrubbing instruments 903 are brushes comprising bristles which contact the extrusion head surface 904 selected both for optimum coating material removal and the need to prevent damage to said head surface 904. Alternatively, the scrubbing instruments could comprise cleaning mechanisms including but not limited to rotating cylindrical sponges, compliant edges which scrape material off the head surface, or high pressure non-contact fluid jets which emit solvent fluid only when pointed at the head surface.

In a preferred embodiment, the axis of the scrubbing instruments are fixed with respect to the scrubbing station housing. Preferably, the positions of the fixed axes of the scrubbing instruments and the dimensions of the instruments themselves, however many there are, may be tailored to the dimensions of a particular extrusion head. Alternatively, the axis positions and dimensions of the scrubbing instruments 903 can be set to safe compromise values which can accommodate all the extrusion heads which the instruments will clean.

In an alternative preferred embodiment, the axes of the scrubbing instruments may be moveable to accommodate extrusion heads of varying dimensions. The axes could move under spring loading in response to the placement of an extrusion head 901 in cleaning position. Alternatively, the scrubbing instruments could be moved under some form of active control, the form of control including but not limited to pneumatic, electrical, hydraulic, gravitational.

In a preferred embodiment, the scrubbing station comprises pumping means for circulating solvent fluid from a reservoir to the scrubbing instruments for cleaning thereof, and for spraying or otherwise directing solvent fluid onto the surface to be cleaned 904 on the extrusion head 901. In this manner, the scrubbing action and chemical activity of the solvent cooperate to optimally clean the extrusion head surface 904.

In a preferred embodiment of the scrubbing station, a strong solvent is used in anticipation of the need to clean highly viscous fluids. Such strong solvents are effective in dissolving viscous fluids but have the effect of leaving residual solvent fluid on the extrusion head surface 904 once scrubbing station operations are complete. In an alternative embodiment, a self drying solvent could be employed which, after aiding the scrubbing instruments in removal of the coating fluid, would completely evaporate without requiring external assistance.

In a preferred embodiment, as already discussed, relative motion between the scrubbing instruments and the extrusion or coating head is provided by rotation of cylindrical scrubbing instruments, preferably brushes. Alternatively, the required relative motion could be provided by scrubbing instruments of different instruments of different geometries comprising linear motion, rotary motion, or a combination of linear and rotary motion. The relative motion could also be provided by movement of the coating head against a mostly or completely stationary scrubbing instrument, or from a combination of motion between the head and the scrubbing instrument.

As previously discussed, priming of the extrusion head is preferably conducted at the priming station (FIG. 6). However, in an alternative preferred embodiment, the extrusion head may conduct a priming operation while positioned at the scrubbing station. The fluid delivery means to the extrusion head extrudes coating material out of the extrusion head slot 902 until the coating bead at the extrusion slot 902 is properly formed. The coating material released during said priming process is preferably absorbed into the scrubbing station solvent pool and dissolved. Priming the extrusion head in this manner obviates the need for the extrusion head to make a separate stop at the priming station. The priming operation may be conducted in succession to, or simultaneous with the scrubbing operation.

Figure 10:
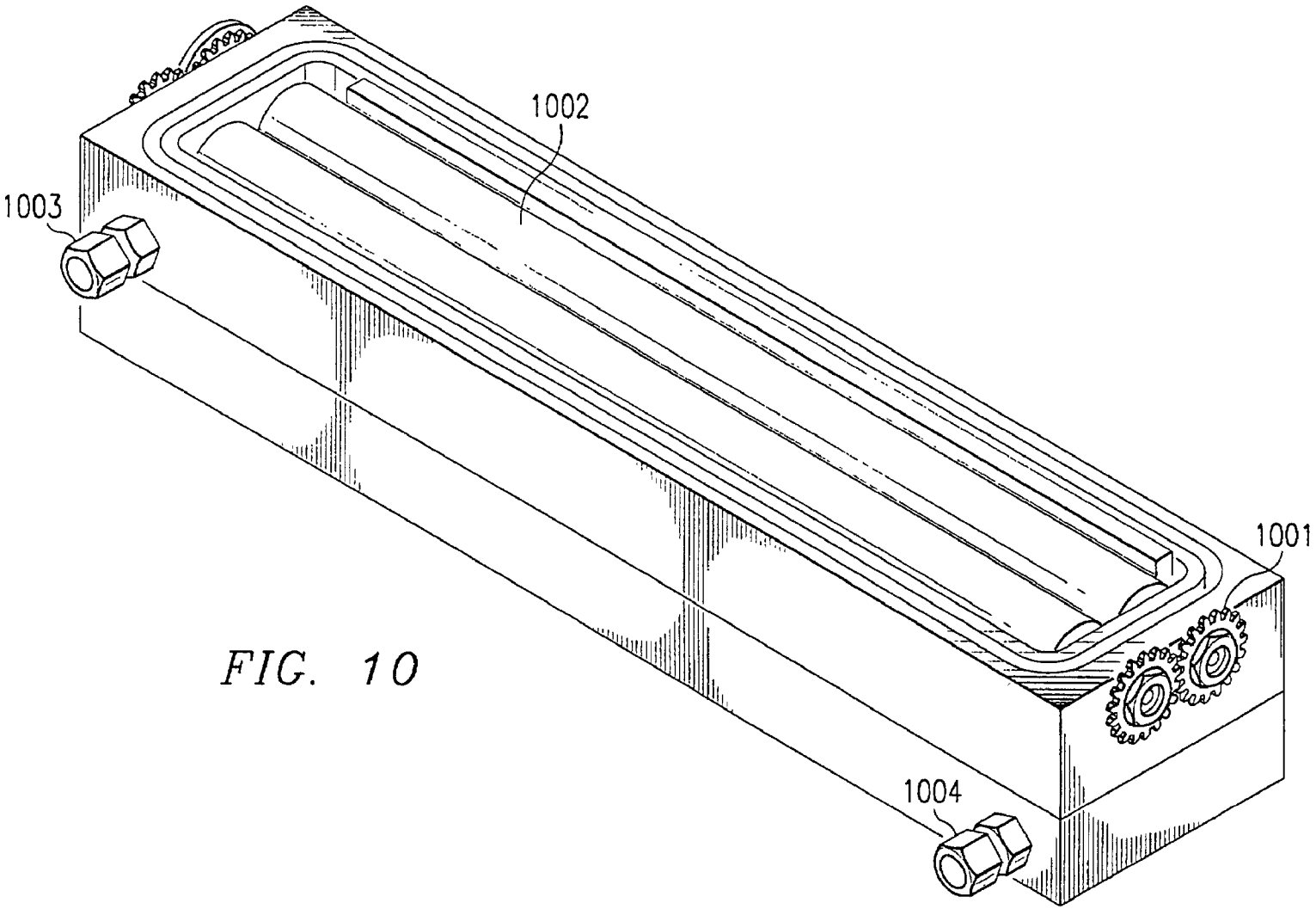
FIG. 10 depicts a scrubbing station according to a preferred embodiment of the present invention.
Figure 13:
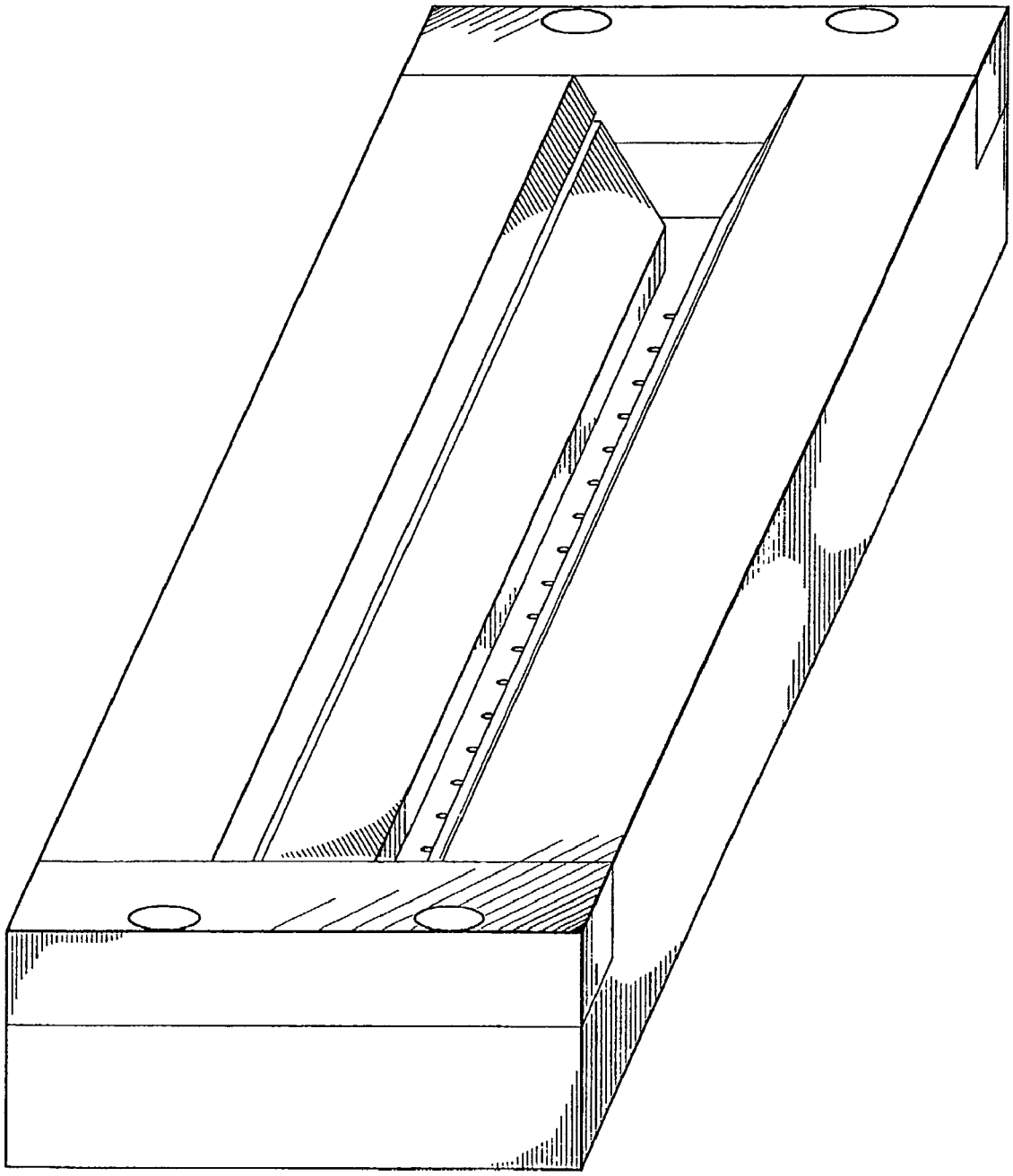
FIG. 13 depicts an isometric view of a rinsing station according to a preferred embodiment of the present invention.
Figure 14:
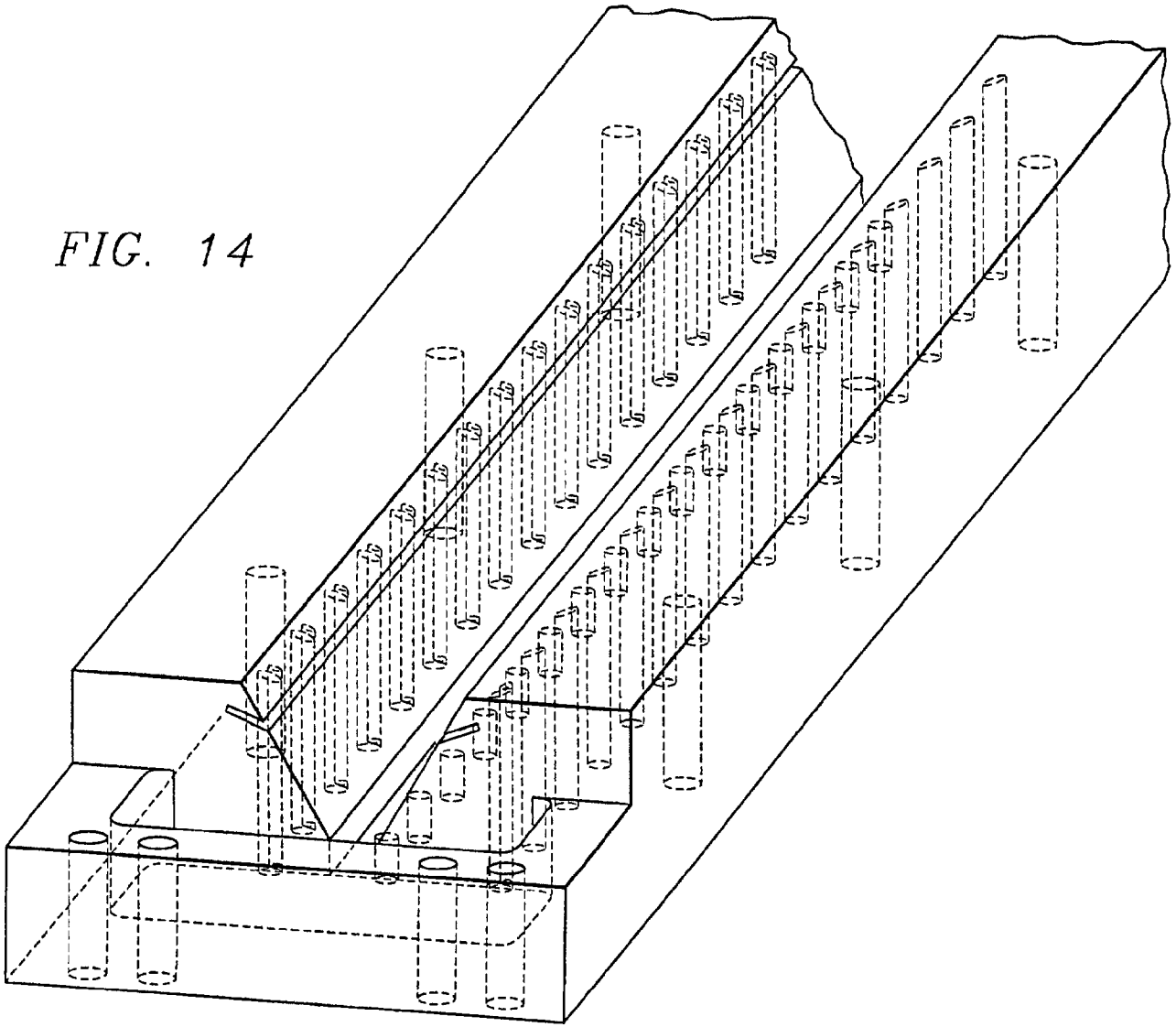
FIG. 14 depicts an isometric view of a rinsing station according to a preferred embodiment of the present invention.

FIG. 10 depicts a scrubbing station according to a preferred embodiment of the present invention. Two scrubbers 1002 are shown whose movement is interlocked by teeth on sprockets 1001 attached to each scrubber 1002. Fluid inlet 1003 allows solvent fluid to enter the scrubbing station, and fluid outlet 1004 permits used fluid to exit the scrubbing station.

Figure 11:
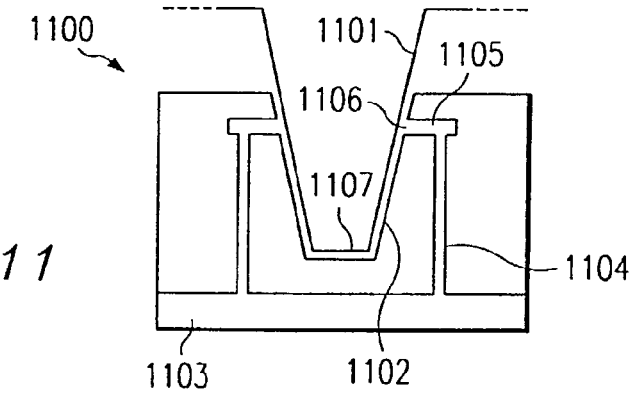
FIG. 11 depicts a section view of a rinsing station according to a preferred embodiment of the present invention.

FIG. 11 depicts a section view of a rinsing station 1100 according to a preferred embodiment of the present invention. The tip of an extrusion head 1101 is shown placed in a roughly V-shaped groove 1102 of the rinsing station 1100. It shall be appreciated that V-shaped groove 1102 is a preferred structure for distributing solvent fluid from a fluid reservoir 1103 to the surface to be cleaned on the extrusion head 1101 and is shown to aid those of skill in the art in understanding the present invention. However, a variety of configurations of rinsing stations may be used in accordance with the concepts of the present invention.

Solvent fluid preferably initially resides in a fluid reservoir 1103. Preferably, fluid pumping or pressuring means (not shown) provides sufficient pressure to the fluid reservoir to permit the fluid to reach the surface to be cleaned with appropriate velocity.

In a preferred embodiment, solvent is preferably pumped from reservoir 1103 up mostly vertical groove 1104 to fluid manifold 1105. The fluid in the manifold or slot 1105 is then directed toward the surface to be cleaned. The spray path 1106 designates a path of fluid flow from the fluid manifold 1105 toward the surface to be cleaned. This path 1106 will be a product of the fluid manifold 1105 geometry, the fluid viscosity, fluid velocity and proximity of the extrusion surface to the outlet of the fluid manifold 1105. The geometry of the fluid manifold 1105, preferably a rectangular slot, fluid pressure and velocity, and location of the extrusion head surface are preferably such as to permit a continuous curtain of fluid along the spray path 1106 to strike the surface to be cleaned along the entire length of the extrusion head. In FIG. 11, the length dimension is in the direction into and out of the page. Provision of a continuous curtain of fluid along the spray path 1106 along the length of the head 1101 helps ensure uniform and thorough cleaning of the head.

The combination of the vertical groove 1104, manifold 1105, and spray path 1106 is but one possible form of a fluid flow structure connecting the solvent reservoir 1103 to the extrusion head 1101. Alternatively, The groove 1104 need not be mostly vertical but need only be disposed to lead pressurized fluid to either to a manifold 1105, or alternatively, directly toward the surface to be cleaned. The groove 1104 can have any cross-sectional geometry including but not limited to circular, oval, square, or rectangular. The fluid flow structure leading fluid from the fluid reservoir 1103 to the extrusion head 1101 may comprise a variety of different paths, cross-sectional geometries, and dimensions. Accordingly, the invention is not limited to the configuration shown in FIG. 11.

In another preferred embodiment, the means for directing fluid toward the surface to be cleaned on the head 1101 comprises directing solvent from the solvent pool 1103 into a porous or sintered material (not shown). When pressurized, the sintered material will supply a curtain of fluid flow towards the surface to be cleaned on the extrusion head 1101.

In a preferred embodiment, a pump is employed to pump the solvent from a reservoir toward the extrusion head surface. The power source for said pump may be the common drive means or motor 201 (FIG. 2) for the entire cleaning and priming assembly, or may be dedicated to the rinsing station 1100.

In a preferred embodiment, the solvent used at the rinsing station 1100 comprises a chemical composition which permits it to evaporate rapidly while being able to dissolve any residual scrubber station solvent and certain less viscous coating fluids. The solvent of this embodiment is best used when the sequence of operations requires servicing the extrusion head at both the scrubbing station and the rinsing station. An advantage of the solvent of this embodiment is that no active step is required to remove rinsing solvent from the extrusion head, as it is self drying or evaporative.

Alternatively, the rinsing station will employ a more powerful but less self-drying or evaporative solvent which is able to remove more viscous coating fluids than the fully self drying solvent. This solvent presents the advantage of being able to directly dissolve a greater range of coating fluids and thereby enable the extrusion head to skip service at the scrubbing station for this greater range of coating fluids. This more powerful rinsing solvent may require active drying in order to assure complete removal of the rinsing solvent from the surface of the extrusion head.

As previously discussed, priming of the extrusion head is preferably conducted at the priming station (FIG. 6). However, in an alternative preferred embodiment, the extrusion head may conduct a priming operation while positioned at the rinsing station 1100. The fluid delivery means to the extrusion head extrudes coating material out of the extrusion head slot 1107 until the coating bead at the extrusion slot 1107 is properly formed. The coating material released during said priming process is preferably absorbed into the rinsing station solvent reservoir and dissolved. Priming the extrusion head in this manner obviates the need for the extrusion head to make a separate stop at the priming station. The priming operation may be conducted in succession to, or simultaneous with the rinsing operation.

Figure 12:
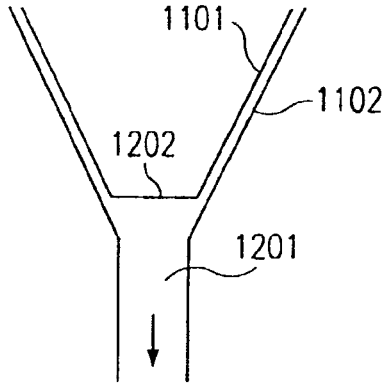
FIG. 12 depicts a section view of a rinsing station according to an alternative preferred embodiment of the present invention.

FIG. 12 depicts a section view of a rinsing station according to an alternative preferred embodiment of the present invention. The extrusion head 1101 is shown placed in the cleaning groove 1102 of the rinsing station. Where active drying of the extrusion head 1102 is needed, air flow is preferably generated in the direction shown in 1201 within a passage way preferably below the slot 1202 in the extrusion head 1101. This air flow accelerates evaporation of any residual rinsing solvent on the extrusion head. Active drying in the manner described is preferably performed when the less evaporative or self-drying rinsing solvents are employed.

In a preferred embodiment, the rinsing solvent is heated either within the fluid reservoir or at some point in between the reservoir and the point where the fluid is sprayed onto the extrusion head. Heating the solvent would enhance cleaning action of the fluid and permit more rapid evaporation of the fluid preferably obviating the need for air flow drying of the rinsing solvent.

Additionally or alternatively, ultrasonic energy is transmitted to the solvent cleaning action thereby acting to energize and enhance the cleaning operation. The head could be oscillated and thereby initiate ultrasonic cleaning action. Alternatively or additionally, ultrasonic energy could originate in the rinsing station and be transmitted to the cleaning operation on the extrusion head via an uninterrupted stream of rinsing solvent fluid.

Depending upon the type of coating fluid to be cleaned, the stations deployed in the cleaning and priming assembly may vary. Where a viscous coating fluid is to be cleaned, the assembly will preferably comprise a scrubbing station since the scrubber's direct mechanical contact is helpful with viscous fluids. The scrubbing station will preferably comprise a powerful solvent for dissolving the viscous fluid. If the solvent used in the scrubbing station is not self-drying, or if there is any chance of coating fluid remaining on the head after the scrubbing operation, a rinsing station will preferably be deployed in the cleaning and priming assembly.

Alternatively, the cleaning and priming assembly will comprise a full set of priming and cleaning stations, but the coating operation concerned will dictate which coating stations get accessed by the extrusion, and in which order.

The rinsing station will preferably employ a solvent which requires no additional action for its removal after departing the rinsing station. Obviating the need for further action can be achieved by employing any combination of a rapidly evaporating solvent, heating the solvent, and ultrasonic agitation of the rinsing process. In the case of a viscous coating fluid, the rinsing station is preferably capable of removing both residual coating fluid as well as scrubbing station solvent remaining on the extrusion head.

The cleaning and priming assembly preferably comprises a dedicated priming station for priming a bead of the coating fluid. Alternatively, a bead of coating fluid can be primed while the extrusion head is at either of the cleaning stations. Priming at the cleaning stations may be preferable for particularly viscous fluids. If it is known in advance that priming will be conducted at one of the cleaning stations for a particular fluid, the dedicated priming station may be omitted from the cleaning and priming assembly, or simply skipped in the sequence of operations relating to servicing the extrusion head.

For less viscous coating fluids, a scrubbing station may not be required. Therefore, the scrubbing station may be omitted from the cleaning and priming assembly where the assembly will be associated with a particular fluid for an extended period of time. Alternatively, the scrubbing station may be included in the assembly but skipped in the sequence of operations relating to servicing the extrusion head. Where the scrubbing operation is skipped, the extrusion head is preferably first serviced by at the rinsing station, and then simultaneously or subsequently primed.

Depending upon the coating material in the extrusion head, and the solvents used in the cleaning stations, a wide range of sequences of operations is possible. In general, treatment of the extrusion head will comprise, at a minimum, stopping at one cleaning station, either the scrubbing or rinsing station. Other servicing stops may be added as the needs of the coating fluid dictate. Possible sequences of operations include, but are not limited to: scrubbing, rinsing, and priming (at priming station); scrubbing and priming (at priming station); scrubbing while simultaneously priming at the scrubbing station; and rinsing while priming at the rinsing station.

When the characteristics of an extrusion head are known and will be associated with a particular cleaning and priming assembly, many characteristics of all stations in the assembly can be tailored to suit the extrusion head and coating material concerned. With respect to the rinsing station, characteristics which can be tailored to the extrusion head include, but are not limited to: the selection of the solvent, the fluid delivery system, the velocity with which the rinsing fluid is delivered to the head, the dimensions of the groove in the station, the rinsing fluid temperature, and the selection to use or not use ultrasonic agitation to catalyze the cleaning process.

With respect to the scrubbing station, the characteristics which can be tailored to suit the extrusion head and the coating material include, but are not limited to the selection of scrubber composition and geometry, the number of scrubbers, the relative placement of the scrubbers within the station, the scrubber movement or rotation velocity, the scrubber cleaning instrument means, the solvent to be employed, the solvent delivery means, and the means for preserving the chemical strength of solvent which has been exposed to coating material.

Characteristics of the priming station and the priming operation can similarly be tailored to suit the extrusion head and coating material to be employed. The priming operation may be conducted at locations other than the priming station including but not limited to the scrubbing and rinsing stations. Characteristics of the priming station which can be tailored to the extrusion head and coating material to be employed include, but are not limited to the solvent bath to be used, the geometry and composition of the priming surface, the relative velocity of the priming surface with respect to the extrusion slot, the mechanism for preserving chemical effectiveness of the solvent bath after dissolution of coating material within it, the temperature of the solvent bath, and the duration of the priming process. If the priming operation is conducted away from the priming station, such as at a cleaning station, coordination preferably includes extruding coating material from the head simultaneously with another operation such as scrubbing or rinsing to save time.

The inventive mechanism for cleaning and priming an extrusion head comprises means for controlling in-process operational parameters at the individual stations in the cleaning and priming assembly and for coordinating the operation of the individual stations with each other and with an overall coating apparatus. Means for controlling these parameters may be integrally mounted within the cleaning and priming assembly, located on the coating apparatus, located remotely from both the assembly and the coating apparatus, or be distributed among these three locations.

At the scrubbing station, in-process parameters to be controlled include rotational velocity of the scrubbing instruments, fluid flow control including velocity and volume flow rate, temperature control of a solvent pool, the duration of the scrubbing process, and optionally, linear and angular positioning of the scrubbing instruments. For example, cleaning viscous fluids would benefit from slower rotation of the scrubbers, lower solvent fluid flow velocity, and optionally, higher temperature solvent. More rapid scrubber rotation and more rapid solvent fluid flow would be effective in dealing with less viscous fluids and enable the cleaning operation to be completed in less time.

At the rinsing station, in-process parameters to be controlled include, but are not limited to the velocity and volumetric flow rate of the rinsing solvent directed toward the extrusion head, the temperature of the rinsing solvent, control of ultrasonic energy directed at the cleaning surface on the extrusion head, and the duration of the rinsing process. Cleaning more viscous fluids would benefit from introduction of cleaning catalysts such as heat and ultrasonic energy to the rinsing process. These catalysts are harmless but less necessary when cleaning less viscous fluids.

At the priming station, in-process parameters to be controlled include, but are not limited to the velocity of the priming surface with respect to the extrusion slot on the head, the head gap between the head and the priming surface, and the rate of coating material extrusion from the head. For example, the rate of coating material extrusion from the head is preferably reduced as the viscosity of the fluid increases. The velocity of the priming surface with respect to the extrusion head would be adjusted in accordance with the coating material extrusion rate, and would accordingly be lower for higher viscosity fluids.

The inventive mechanism provides for coordination between control of the coating apparatus, including the extrusion head, and the operations within the stations in the cleaning and priming assembly. Coordination preferably includes, but is not limited to the ability of control means to turn power on and off to appliances including, but not limited to rotation of the scrubbers, fluid flow in the scrubbing and rinsing stations, and rotation of the priming roller. Another process preferably incorporating coordination is the process of priming the head over the priming station. When priming, the rate of coating material extrusion from the extrusion head is preferably coordinated with the velocity of priming surface movement which, in a preferred embodiment, is the rotational velocity of a priming roller.

Alternatively, the velocity of the priming roller as well as other operating parameters at the various stations could be process independent. Specifically, the priming roller, and scrubbing instruments could have constant velocities regardless of the operating parameters of the extrusion head or any other part of the coating apparatus.

It should be appreciated from the above discussion that the present invention allows the disposing of apparatus for the automated servicing of extrusion coating mechanisms in a relatively small footprint which is easily disposed within the range of movement of an extrusion coating head. Accordingly, the servicing of such an extrusion head may easily be conducted periodically and throughout the coating process to thereby provide an improved extrusion coating.

Although the present invention and its advantages have been described in detail, it should be understood that various changes, substitutions and alterations can be made herein without departing from the spirit and scope of the invention as defined by the appended claims.

What is claimed is:

1. A priming device for generating a steady state condition in an extrusion head for applying a coating on a surface of a substrate, the priming device comprising:

a rotating priming roller comprising a priming surface having a crown positioned proximate the extrusion head, wherein the roller is partially submerged in a coating solvent pool with the crown extending exterior of the solvent pool;

a wet scraper submerged in the solvent pool and in contact with the priming surface;

at least one nozzle positioned to spray a solvent on the priming surface exterior of the solvent pool after the solvent pool relative to the rotation of the priming surface; and means for exhausting gases.

2. The priming device of claim 1 further including a dry scraper positioned exterior of the solvent pool and in contact with the priming surface.

3. The priming device of claim 1 further including a substantially vertical scraper positioned exterior of the solvent pool and in contact with the priming surface before the solvent pool relative to the rotation of the priming surface.

4. The priming device of claim 2 further including a substantially vertical scraper positioned exterior of the solvent pool and in contact with the priming surface before the solvent pool relative to the rotation of the priming surface.

5. The priming device of claim 1 further including a means for removing waste material from the solvent pool.

6. The priming device of claim 2 further including a means for removing waste material from the solvent pool.

7. The priming device of claim 3 further including a means for removing waste material from the solvent pool.

8. The priming device of claim 4 further including a means for removing waste material from the solvent pool.

9. The priming device of claim 5 wherein the means for removing waste material comprises an auger system.

10. The priming device of claim 6 wherein the means for removing waste material comprises an auger system.

11. The priming device of claim 7 wherein the means for removing waste material comprises an auger system.

12. The priming device of claim 8 wherein the means for removing waste material comprises an auger system.

13. A priming device not generating a steady state condition in an extrusion head for applying a coating on a surface of a substrate, the priming device comprising:

a rotating priming roller comprising a priming surface having a crown positioned proximate the extrusion head, wherein the roller is partially submerged in a coating solvent pool with the crown extending exterior of the solvent pool;

a substantially vertical scraper positioned exterior of the solvent pool and in contact with the priming surface before the solvent pool relative to the rotation of the priming surface;

at least one nozzle positioned to spray a solvent on the priming surface exterior of the solvent pool after the solvent pool relative to the rotation of the priming surface; and means for exhausting gases.

14. The priming device of claim 13 further including a wet scraper submerged in the solvent pool and in contact with the priming surface.

15. The priming device of claim 13 further including a dry scraper positioned exterior of the solvent pool and in contact with the priming surface after the nozzles relative to the rotation of the priming surface.

16. The priming device of claim 14 further including a dry scraper positioned exterior of the solvent pool and in contact with the priming surface after the nozzles relative to the rotation of the priming surface.

17. The priming device of claim 13 further including a means for removing waste material from the solvent pool.

18. The priming device of claim 14 further including a means for removing waste material from the solvent pool.

19. The priming device of claim 15 further including a means for removing waste material from the solvent pool.

20. The priming device of claim 16 further including a means for removing waste material from the solvent pool.

* * * * *